US007832824B1

(12) United States Patent
Erdtmann et al.

(10) Patent No.: US 7,832,824 B1
(45) Date of Patent: Nov. 16, 2010

(54) METHOD FOR PRINTING WITH AN ACCELERATING PRINTHEAD

(75) Inventors: David Erdtmann, Rochester, NY (US); Steven A. Billow, Victor, NY (US); James A. Reczek, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/432,802

(22) Filed: Apr. 30, 2009

(51) Int. Cl.
*B41J 29/38* (2006.01)
*B41J 2/15* (2006.01)
*B41J 2/145* (2006.01)

(52) U.S. Cl. ..... 347/14; 347/41

(58) Field of Classification Search ..... 347/14, 347/15, 19, 37
See application file for complete search history.

(56) References Cited

U.S. PATENT DOCUMENTS 4,528,576 A 7/1985 Koumura et al.
5,873,663 A 2/1999 Yokoi et al.
6,419,338 B1 7/2002 Ikeda
7,350,902 B2 4/2008 Dietl et al.
2008/0084464 A1 4/2008 Saga et al.
2008/0136855 A1 6/2008 Ochiai et al.
2008/0309952 A9 12/2008 Billow et al.

*Primary Examiner*—Matthew Luu
*Assistant Examiner*—Lisa M Solomon
(74) *Attorney, Agent, or Firm*—Kevin E. Spaulding

(57) ABSTRACT

A method for printing input digital images using an inkjet printing system having a first and second drop ejector arrays for ejecting drops of a particular ink, wherein ink paths supplying drop ejector arrays have different length projections. The method comprising printing a first combined number of ink dots using the first and second drop ejector arrays during first and third time intervals where the printhead is accelerating and decelerating; and printing a second combined number of ink dots using the first and second drop ejector arrays during a second time interval where the printhead is moving at a substantially constant velocity, wherein the percentage of ink dots that are printed by the drop ejector array having a longer length projection is less than 40% of the corresponding combined number of ink dots in at least one of the first or third time intervals.

19 Claims, 17 Drawing Sheets

METHOD FOR PRINTING WITH AN ACCELERATING PRINTHEAD

CROSS REFERENCE TO RELATED APPLICATIONS

Reference is made to commonly assigned, co-pending U.S. patent application Ser. No. 12/407,130 filed Mar. 19, 2009, entitled "IMAGE DATA EXPANSION BY PRINT MASK" by Christopher Rueby and Douglas Couwenhoven.

FIELD OF THE INVENTION

This invention relates generally to the field of inkjet printing, and more particularly to the allocation of printing data between different drop ejector arrays for a particular color ink in a carriage printer when the carriage is accelerating or decelerating.

BACKGROUND OF THE INVENTION

Many types of printing systems include one or more printheads that have arrays of marking elements that are controlled to make marks of particular sizes, colors and densities in particular locations on the print media in order to print the desired image. In some types of printing systems, the array of marking elements extends across the width of the page, and the image can be printed one line at a time. However, the cost of a printhead that includes a page-width array of marking elements is too high for some types of printing applications, so a carriage printing architecture is often used.

In a carriage printing system such as a desktop printer, or a large area plotter, the printhead or printheads are mounted on a carriage that is moved past the recording medium in a carriage scan direction as the marking elements are actuated to make a swath of dots. At the end of the swath, the carriage is stopped, printing is temporarily halted and the recording medium is advanced. Then another swath is printed, so that the image is formed swath by swath. In a carriage printer, the marking element arrays are typically disposed along an array direction that is substantially parallel to the media advance direction, and substantially perpendicular to the carriage scan direction. The length of the marking element array determines the maximum swath height that can be used to print an image.

In an inkjet printer, the marking elements are drop ejectors, where each drop ejector includes a nozzle and a drop forming mechanism, such as a bubble-nucleating heater. Some carriage printers have more than one drop ejector array for printing a particular ink. This enables faster printing throughput because within a swath some dots are printed by one drop ejector array and some dots are printed by another drop ejector array. The carriage velocity is therefore not limited by the maximum refill frequency of a single drop ejector. In addition, by having some dots printed by two different drop ejector arrays in a single pass, printing defects from either drop ejector array are disguised by the dots that are printed by the other drop ejector array. For example, if drops from a particular drop ejector are misdirected in a first drop ejector array there could be a white line in an image if only that drop ejector array were used to print in a single pass. By using two different drop ejector arrays, dots from a corresponding drop ejector of the other drop ejector array can partially fill in the white line, and disguise the defect somewhat. In other words, good image quality can be provided in fewer multiple printing passes if there is more than one drop ejector array for a particular ink.

Faster printing throughput can also be achieved by printing at a faster carriage speed. However, the distance d required to accelerate from a stopped position to a constant velocity $v_c$ is given by $d=v_c^2/2a$, where a is the acceleration. Therefore, as the carriage velocity is increased, it is desirable to increase the acceleration so that the width of the acceleration region doesn't increase to unacceptable levels, requiring that the printer be significantly wider than the print media. In order to further increase printing throughput, some printers print during acceleration or deceleration. However, acceleration and deceleration of the carriage can cause ink pressure changes that can result in image quality degradation under certain circumstances, particularly for large magnitudes of acceleration or deceleration.

Although the use of two drop ejector arrays to print dots of a particular ink can provide increased printing throughput by sharing the printing responsibilities in printing regions where there is substantially constant carriage velocity or low levels of acceleration, it would be advantageous to enable further increases in printing throughput by printing at increased levels of acceleration, while providing excellent image quality.

SUMMARY OF THE INVENTION

In accordance with the present invention, there is provided a method for printing input digital images using an inkjet printing system having a printhead that moves laterally in reciprocating fashion along a scan axis, the printhead including first and second drop ejector arrays for ejecting drops of a particular ink wherein a first ink path supplying the first drop ejector array is characterized by a first length projection along the carriage scan axis; and a second ink path supplying the second drop ejector array is characterized by a second length projection along the carriage scan axis, the first length projection being longer than the second length projection, the method comprising:

a) printing a first combined number of ink dots of the particular ink on a recording medium using the first and second drop ejector arrays during a first time interval where the printhead is accelerating from a stopped position;

b) printing a second combined number of ink dots of the particular ink on the recording medium using the first and second drop ejector arrays during a second time interval where the printhead is moving at a substantially constant velocity, wherein the percentage of ink dots that are printed by the first drop ejector array is between 40% and 80% of the second combined number of ink dots; and c) printing a third combined number of ink dots of the particular ink on a recording medium using the first and second drop ejector arrays during a third time interval where the printhead is decelerating to a stopped position, and further wherein the percentage of ink dots that are printed by the first drop ejector array is less than 40% of the corresponding combined number of ink dots in at least one of the first or third time intervals.

An advantage of the present invention is that increased print speeds can be achieved for ink jet printers having two or drop ejector arrays for ejecting drops of a particular ink. This advantage is achieved by preferentially utilizing the drop ejector array having a shorter length projection during times of high printhead acceleration or deceleration.

Another advantage of the present invention is that reduced levels of artifacts associated with ink pressure changes can be achieved without sacrificing print speed. In particular, artifacts can be avoided associated with excessive positive pressure which can cause the ink meniscus to advance so far beyond the nozzle face that the meniscus breaks and floods the nozzle face with ink.

Similarly, artifacts can be avoided associated with excessive negative pressure which can cause the ink meniscus to retreat from the nozzle face so that the drop volume can become smaller, and the refill frequency is lowered.

DETAILED DESCRIPTION OF THE INVENTION

Figure 1:
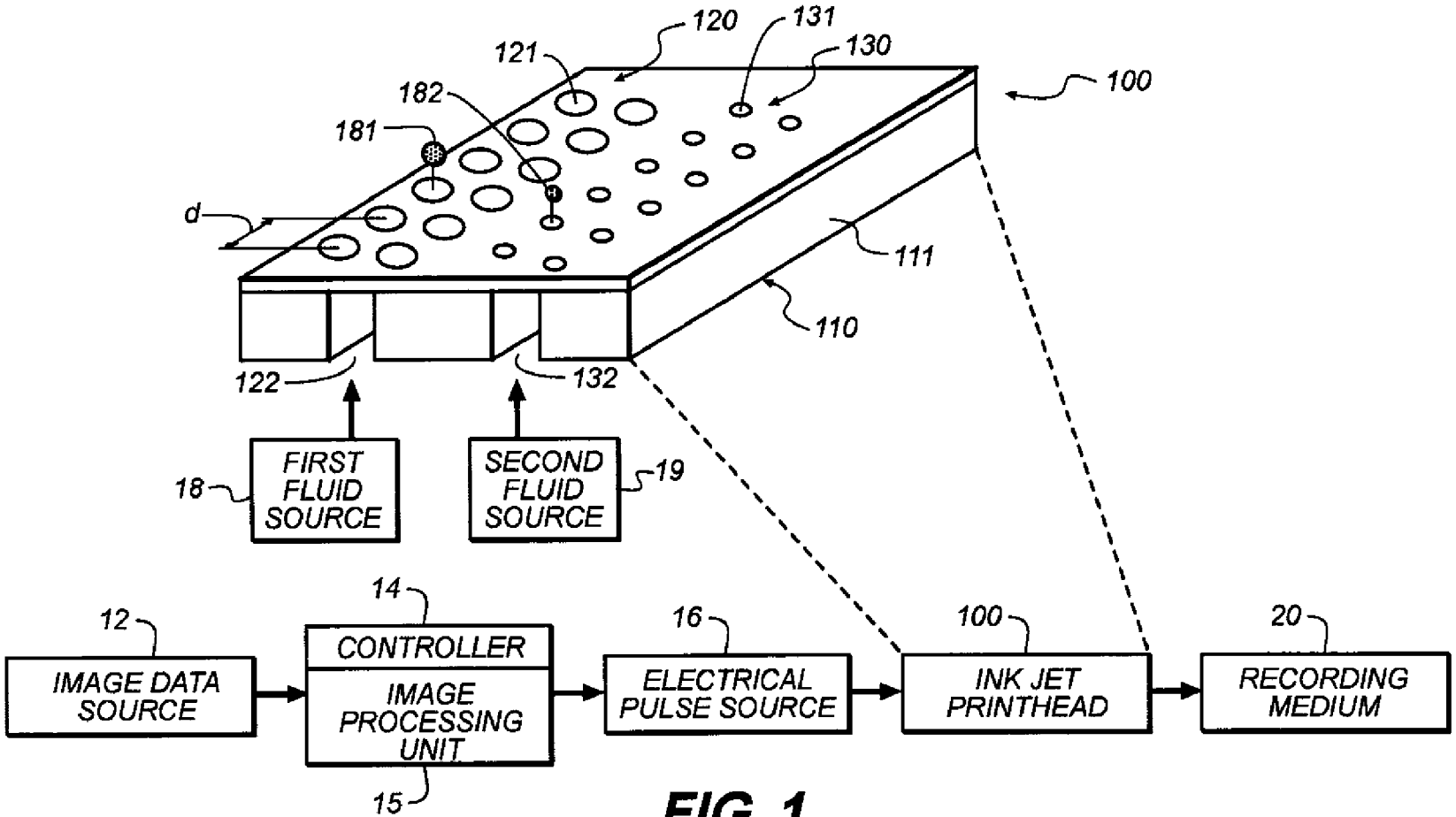
FIG. 1 is a schematic representation of an inkjet printer system that can be used in accordance with the present invention.

Referring to FIG. 1, a schematic representation of an inkjet printer system is shown that is useful with the present invention. This inkjet printer system is fully described in U.S. Pat. No. 7,350,902, which is incorporated by reference herein in its entirety. The inkjet printer system includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110. Optionally, image processing unit 15 is partially included directly in the inkjet printer system, and partially included in a host computer.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. $d=1/1200$ inch in FIG. 1). If pixels on a recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. A first ink delivery pathway 122 is in fluid communication with the first nozzle array 120, and a second ink delivery pathway 132 is in fluid communication with the second nozzle array 130. Portions of ink delivery pathways 122 and 132 are shown in FIG. 1 as openings through substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first fluid source 18 supplies ink to the first nozzle array 120 via the first ink delivery pathway 122, and second fluid source 19 supplies ink to the second nozzle array 130 via the second ink delivery pathway 132. Although distinct fluid sources 18 and 19 are shown, in some applications it can be beneficial to have a single fluid source supplying ink to both the first nozzle array 120 and the second nozzle array 130 via ink delivery pathways 122 and 132, respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of an ink droplet, or a piezoelectric transducer to constrict the volume of a fluid chamber and thereby cause ejection of an ink droplet, or an actuator which is made to move (for example, by heating a bi-layer element) and thereby cause ejection of an ink droplet. In any case, electrical pulses from electrical pulse source 16 are sent to the various drop ejectors according to the desired deposition pattern. In the example of FIG. 1, ink droplets 181 ejected from the first nozzle array 120 are larger than ink droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on the recording medium 20. A nozzle plus its associated drop forming mechanism are included in a drop ejector. Sometimes herein the terms drop ejector array and nozzle array are used interchangeably.

Figure 2:
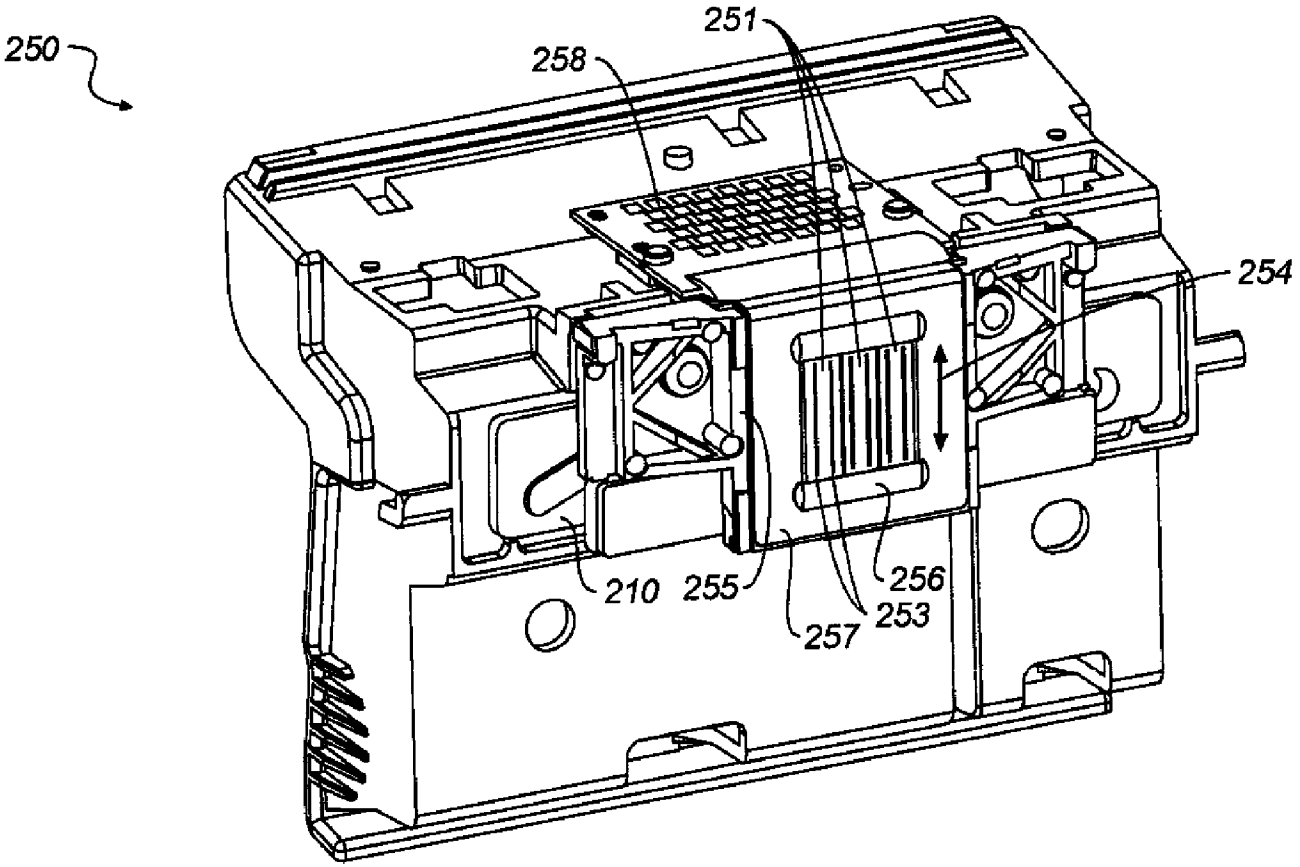
FIG. 2 is a perspective of a portion of a printhead chassis that can be used in the inkjet printer system of FIG. 1.

FIG. 2 shows a perspective of a portion of a printhead chassis 250, which is an example of an inkjet printhead 100 as shown in FIG. 1. Printhead chassis 250 includes three printhead die 251 (similar to printhead die 110 in FIG. 1), each printhead die 251 containing two nozzle arrays 253, so that printhead chassis 250 contains six nozzle arrays 253 altogether. The three printhead die 251 are bonded to a mounting support member 255, which provides a planar mounting surface for the printhead die 251, as well as ink feed passages (not shown) that provide ink to respective ink openings in the substrates of printhead die 251. Manifold 210 (described below with reference to FIG. 7) provides ink passages that lead to the corresponding ink feed passages of mounting support member 255. The six nozzle arrays 253 in this example can be each connected to separate ink sources (not shown), such as cyan, magenta, yellow, black and a colorless fluid. Optionally, two nozzle arrays can be provided with a same color ink, such as black ink for higher speed black printing.

Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches), or 11 inches for cut sheet paper (8.5 by 11 inches) in a desktop carriage printer, or several feet for roll-fed paper in a wide format printer. Thus, in order to print a full image, a number of swaths are successively printed while moving printhead chassis 250 across the recording medium 20. Following the printing of a swath, the recording medium 20 is advanced in a direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals can be transmitted to the printhead die 251.

Figure 3:
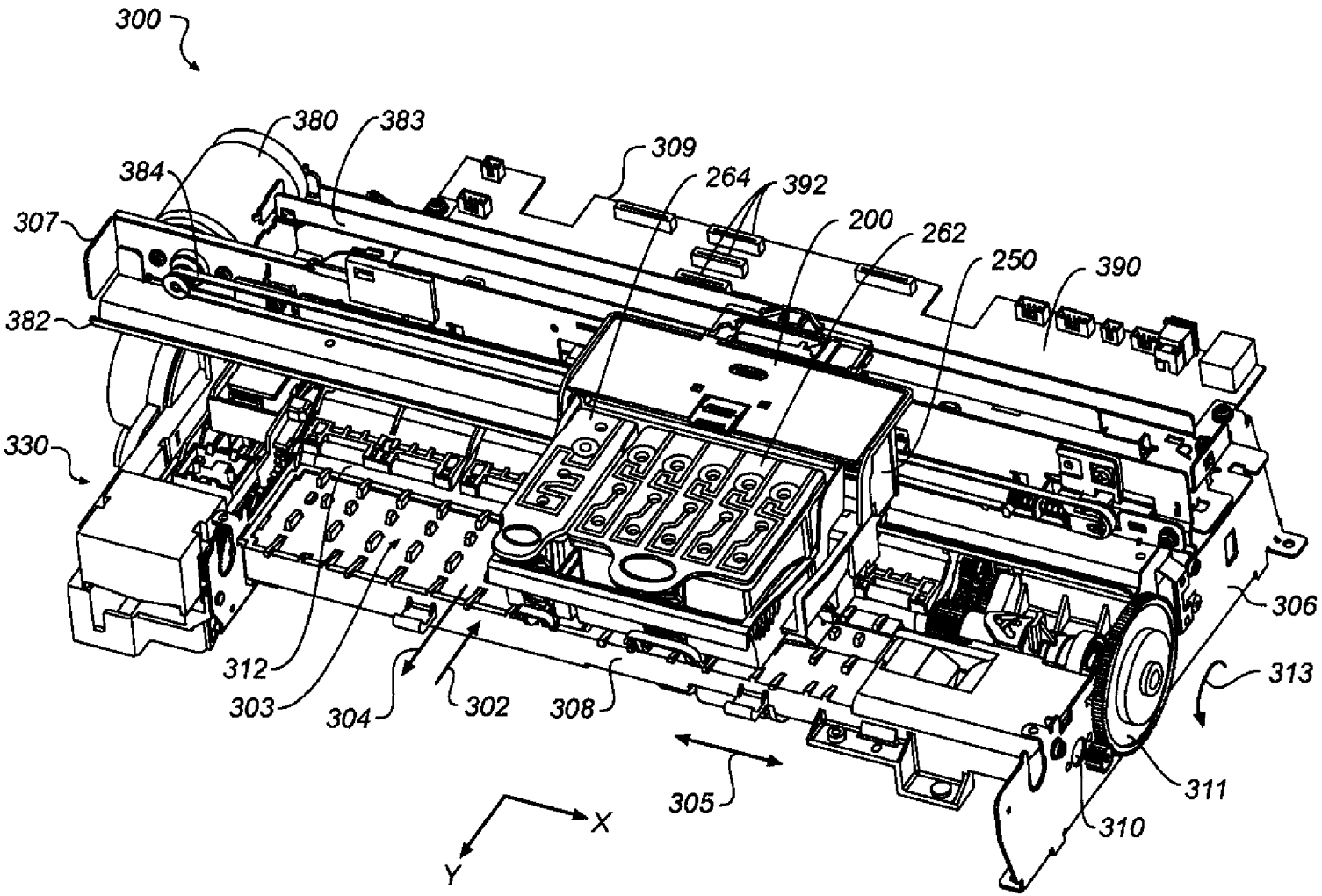
FIG. 3 is a top perspective of a portion of a carriage printer.

FIG. 3 shows a top perspective of a printer chassis 300 for a desktop carriage printer. Some of the parts of the printer have been hidden in the view shown in FIG. 3 so that other parts can be more clearly seen. The printer chassis has a print region 303 across which carriage 200 is moved back and forth (also sometimes called rightward and leftward passes herein) along carriage scan axis 305 (parallel to the X axis), between the right side of printer chassis 306 and the left side of printer chassis 307, while drops are ejected from printhead die 251 (not shown in FIG. 3) on printhead chassis 250 that is mounted on carriage 200. Carriage motor 380 moves belt 384 to move carriage 200 laterally along carriage guide rail 382 in reciprocating fashion. An encoder sensor (not shown) is mounted on carriage 200 and indicates carriage location relative to an encoder fence 383.

Printhead chassis 250 is mounted in carriage 200, and multi-chamber ink supply 262 and single-chamber ink supply 264 are mounted in the printhead chassis 250. The mounting orientation of printhead chassis 250 is rotated relative to the view in FIG. 2, so that the printhead die 251 are located at the bottom side of printhead chassis 250, the droplets of ink being ejected downward onto the recording medium in print region 303 in the view of FIG. 3. Paper or other recording medium (sometimes generically referred to as paper or media herein) is loaded along paper load entry direction 302 toward the front of printer chassis 308.

Figure 4:
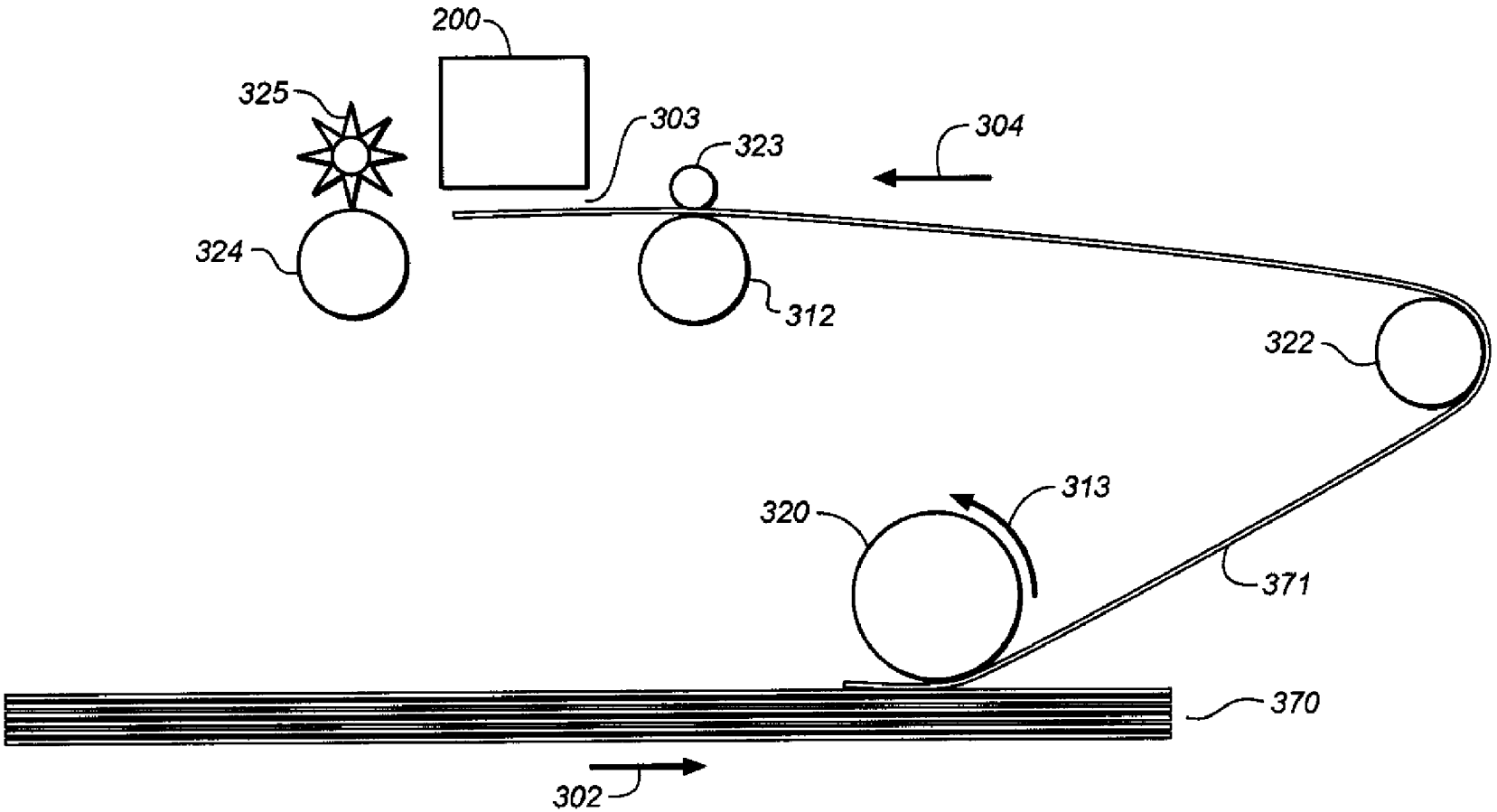
FIG. 4 is a schematic side view of an exemplary paper path in a carriage printer.

A variety of rollers are used to advance the medium through the printer as shown schematically in the side view of FIG. 4. In this example, a pick-up roller 320 moves the top piece or sheet 371 of a stack 370 of paper or other recording medium in the paper load entry direction 302. A turn roller 322 acts to move the paper around a C-shaped path (in cooperation with a curved rear wall surface) so that the paper continues to advance along media advance direction 304 from the rear of the printer chassis 309 (with reference to FIG. 3). The paper is then moved by feed roller 312 and idler roller 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 (see FIG. 3) is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but a hole 310 on the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330.

Toward the rear of the printer chassis 309, in this example, is located the electronics board 390, which includes cable connectors 392 for communicating via cables (not shown) to the printhead carriage 200 and from there to the printhead chassis 250. Also on the electronics board are typically mounted motor controllers for the carriage motor 380 and for the paper advance motor, a processor or other control electronics (shown schematically as controller 14 and image processing unit 15 in FIG. 1) for controlling the printing process, and a connector for a cable to a host computer.

Figure 5:
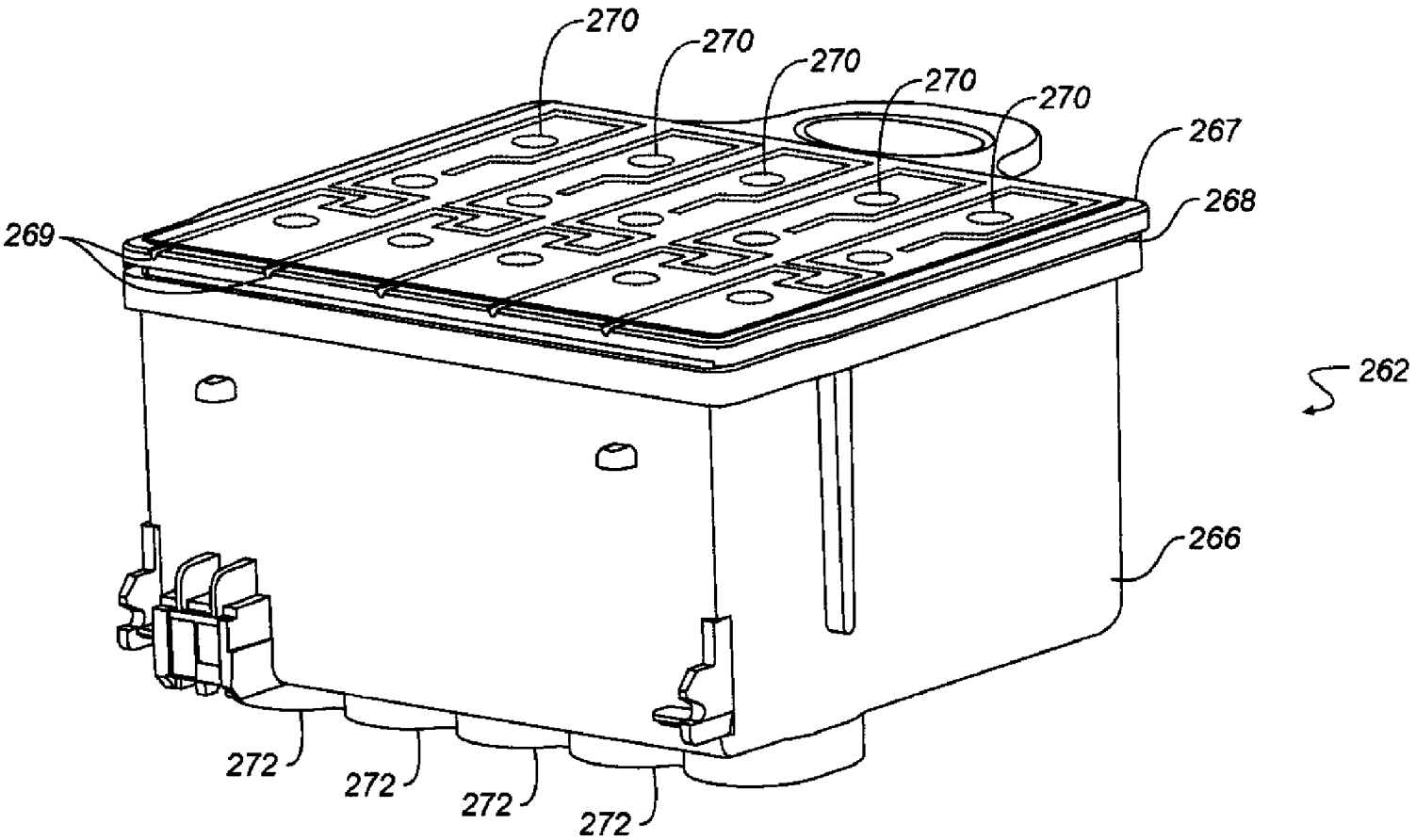
FIG. 5 is a perspective of a multi-chamber ink supply.

FIG. 5 shows a perspective of multi-chamber ink supply 262 removed from printhead chassis 250. Multi-chamber ink supply 262 includes a supply body 266 and a lid 267 that is sealed (e.g. by welding) to ink supply body 266 at lid sealing interface 268. Lid 267 individually seals all of the chambers 270 in the ink supply. In the example shown in FIG. 5, multi-chamber ink supply 262 has five chambers 270 below lid 267, and each chamber has a corresponding ink supply port 272 that is used to transfer ink to the printhead die 251. As shown in FIG. 3, the ink supplies 262 and 264 are mounted on the carriage 200 printer chassis 300, such that the lid 267 is at an upper surface, and correspondingly ink supply ports 272 are at a lower surface. Corresponding to each chamber position, there is a circuitous air path in lid 267 (shown as dotted lines) that exits the side of lid 267 at vents 269 (only two of which are labeled in FIG. 5 for improved clarity). Vents 269 help to relieve pressure differences in chamber 270 as ink is depleted during usage.

Figure 6:
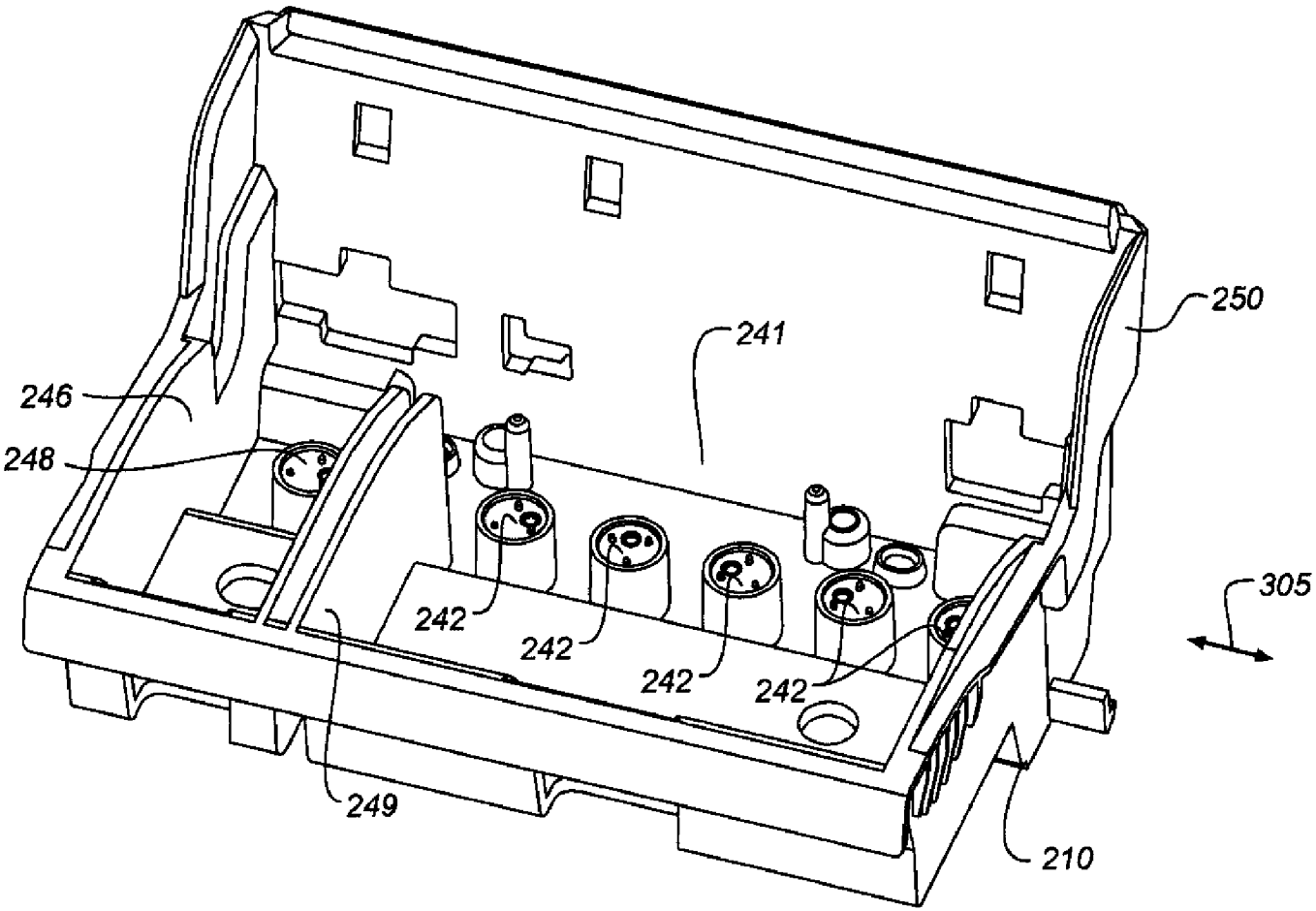
FIG. 6 is a perspective of a portion of a printhead chassis, rotated from the view of FIG. 2.

FIG. 6 shows a top perspective of the printhead chassis 250 without either replaceable ink supply 262 or 264 mounted in it. Multi-chamber ink supply 262 is mountable in a multi-chamber ink supply region 241 and single-chamber ink supply 264 is mountable in a single-chamber ink supply region 246 of printhead chassis 250. Multi-chamber ink supply region 241 is separated from single-chamber ink supply region 246 by partitioning wall 249, which can also help guide the ink supplies during insertion. Five multi-chamber ink supply connection ports 242 are shown in multi-chamber ink supply region 241 that connect with ink supply ports 272 of multi-chamber ink supply 262 when it is installed, and one single-chamber ink supply connection port 248 is shown in single-chamber ink supply region 246 for the ink supply port on the single-chamber ink supply 264. When an ink supply is installed in the printhead chassis 250, it is in fluid communication with the printhead because of the connection of ink supply port 272 with connection ports 242 or 248. When the printhead chassis 250 is installed in carriage 200 of the printer (with reference to FIG. 3), connection ports 242 and 248 are displaced with respect to each other along the carriage scan axis 305.

In order to provide sufficient capacity for storing ink, the ink chambers 270 are typically wider than the spacing between drop ejector arrays 253 (with reference to FIG. 2), so that connection ports 242 and 248 are not directly in line with ink feed passages in mounting support member 255. In other words, the connection ports 242 and 248 are more widely spaced along carriage scan axis 305 than the drop ejector arrays 253.

Figure 7:
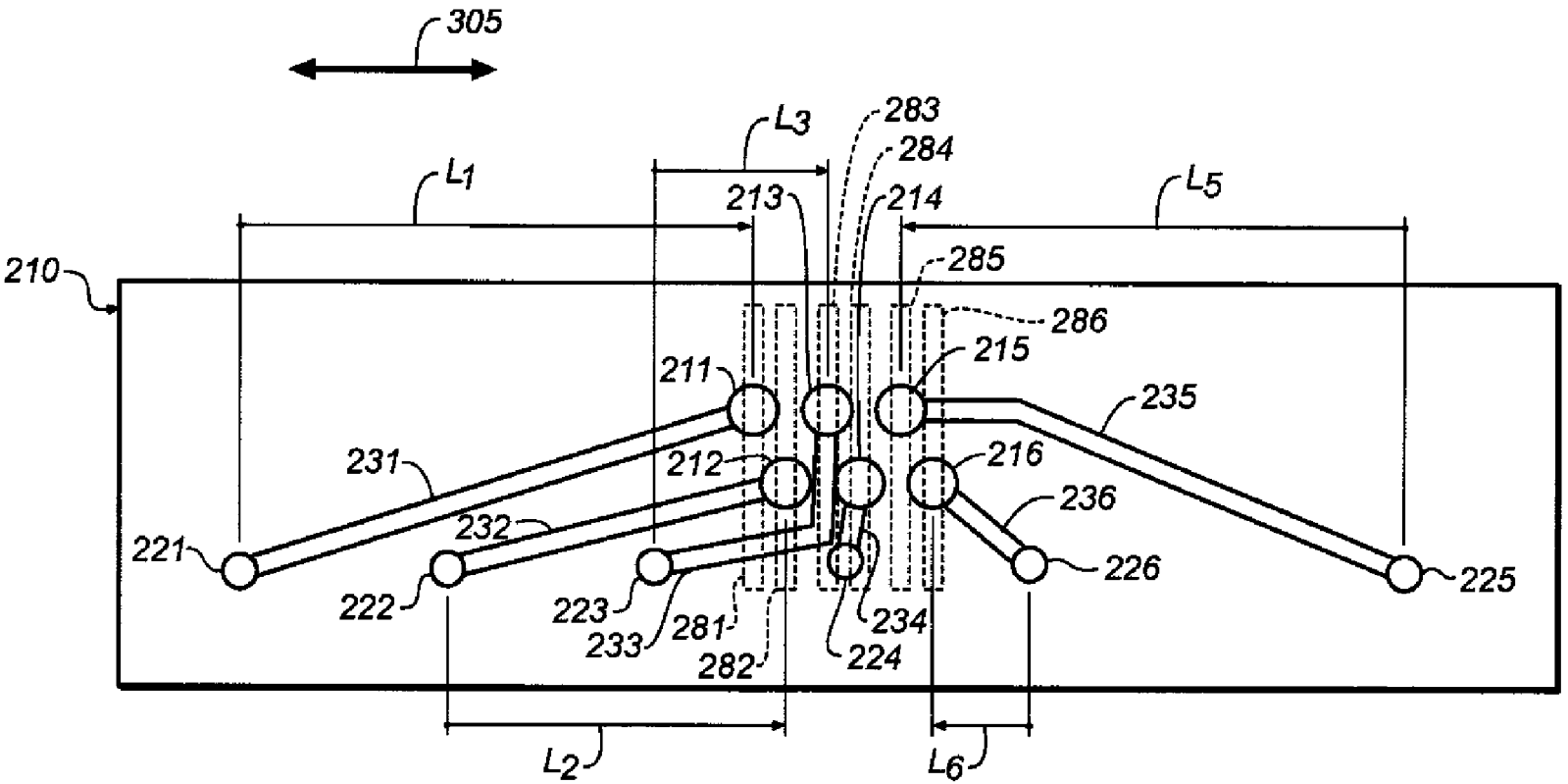
FIG. 7 is a bottom view of a manifold for providing ink passages from ink supply ports to feed passages near ink openings in the printhead die.

FIG. 7 shows a bottom view (opposite sense from FIGS. 3 and 6) of the manifold 210 that provides passageways from connection ports 242 and 248 to the ink feed passages 281-286 (shown as dotted rectangles to indicate their position relative to the manifold 210) in mounting support member 255 in order to provide ink to respective ink openings in the substrates of printhead die 251. Manifold 210 includes six manifold exit ports 211-216 that are aligned respectively with the six ink feed passages 281-286 in mounting substrate 255. Ink enters manifold 210 at manifold entry ports 221-226, which are aligned with the connection ports 242 and 248 at a face opposite the face where the ink supply ports 272 contact. In a particular example, the distance between endmost ink feed passages 281 and 286 is about 1 cm, and the distance between endmost manifold entry ports 221 and 225 is about 7 cm.

Manifold passages 231-236 are provided to bring ink from a manifold entry port to the corresponding manifold exit port. The manifold passages 231-236 have projections along the carriage scan axis 305 that are of different lengths. In other words, manifold passage 231 (joining manifold entry port 221 and manifold exit port 211) has a projection along carriage scan axis 305 of length $L_1$. Manifold passage 233 (joining manifold entry port 223 and manifold exit port 213) has a projection along carriage scan axis 305 of length $L_3$, where $L_3<L_1$. The projection for manifold passage 234 is very short and is not labeled for clarity. In FIG. 7, which represents a bottom view of manifold 210, manifold entry ports 221-224 are to the left of the corresponding manifold exit ports 211-214, while manifold entry ports 225 and 226 are to the right of the corresponding manifold exit ports 215 and 216.

Manifold entry port 225 corresponds to single-chamber ink supply 264, which typically holds black ink for printing text. In the top perspective of the printer chassis seen in FIG. 3, the single-chamber ink supply 264 is to the left of multi-chamber ink supply 262. Thus, as the carriage is moved along carriage scan axis 305 from the left side of the printer chassis 307 toward the right side of the printer chassis 306 (a rightward printing pass), the direction of carriage travel is in the same direction as the projection $L_5$ of manifold passage 235 from the manifold entry port 225 to the manifold exit port 215. For a leftward printing pass, the direction of carriage travel is in the opposite direction of the projection $L_5$ of manifold passage 235 from the manifold entry port 225 to the manifold exit port 215.

As the carriage accelerates at the beginning of its travel and decelerates at the end of its travel, this produces a pressure change in the ink at the nozzles 121, the magnitude and sign of which depend on direction of travel, acceleration vs. deceleration, length of the carriage-scan-axis projection of the manifold passage, and direction of the carriage-scan-axis projection of the manifold passage from the manifold entry port to the manifold exit port. Such pressure changes can have adverse effects on printing during acceleration and deceleration. Excessive positive pressure can cause the ink meniscus to advance so far beyond the nozzle face that the meniscus breaks and floods the nozzle face with ink. Excessive negative pressure can cause the ink meniscus to retreat from the nozzle face so that the drop volume can become smaller, and the refill frequency is lowered.

The pressure change on the ink at one of the ink feed passages 281-286 due to ink in the corresponding manifold passage 231-236 between one of the manifold entry ports 221-226 and the corresponding manifold exit port 211-216 can be expressed in terms of p (the density of ink), a (the carriage acceleration magnitude "a" and direction), and L (the projection of the manifold passage along the carriage scan axis). Let Δl be a vector describing a straight portion of a manifold passage where the starting point of the vector is closer to the manifold entry port and the ending point of the vector is closer to the manifold exit port. For straight line manifold passages such as 231, 232, 234 and 236, Δl is the vector from the manifold entry port to the manifold exit port. For manifold passages such as 233 and 235, which are made of a plurality of segments, the contributions from the segments can be summed or integrated. Acceleration is positive if velocity is increasing or negative if velocity is decreasing (i.e. the carriage is decelerating). The change in pressure ΔP is given by:

$$\Delta P=-\rho\Delta l\cdot a=-\rho\Delta l a\cos\theta \quad (1)$$

where θ is the angle between the acceleration vector and the vector describing the straight portion of the manifold passage. Since the acceleration is along the carriage scan axis 305, the dot product Δl·a is the magnitude of acceleration times the projection of the segment of the manifold passage along the carriage axis. Whether for a single segment or multiple straight segments, the magnitude of the pressure change is:

$$|\Delta P|=\rho La \quad (2)$$

where L is the carriage-scan-axis projection of the entire manifold passage from the manifold entry port to the manifold exit port.

If the velocity is increasing, and a line from the manifold entry port to the manifold exit port has a carriage-scan-axis projection that points in the direction that the carriage is traveling, then the pressure change ΔP at the ink feed passage is negative, corresponding to a negative pressure change on the ink meniscus at the nozzles that are fed by that ink feed passage. If the velocity is increasing and the projection points opposite the direction that the carriage is traveling, then the pressure change at the ink feed passage is positive. Similarly, if the velocity is decreasing and the projection points in the direction that the carriage is traveling, then the pressure change at the ink feed passage is positive, but if the projection points opposite the direction that the carriage is traveling, then the pressure change at the ink feed passage is negative.

Consider an example, with reference to the bottom view of FIG. 7, where length projection $L_1$ of manifold passage 231 is 3 cm pointing to the right, length projection $L_3$ of manifold passage 233 is 1 cm pointing to the right, and length projection $L_5$ of manifold passage 235 is 3 cm pointing to the left. Assume that the inks in those manifold passages have a density of approximately 1 g/cm$^3$, and that the acceleration is 2000 cm/s$^2$ (about 2× the acceleration due to gravity) with carriage velocity increasing and with manifold 210 moving toward the right in the bottom view of FIG. 7 (i.e. the carriage 200 is moving toward the left in a leftward pass in the top perspective of FIG. 3). Then the pressure at ink feed passage 281 will increase by about 6000 dynes/cm$^2$, the pressure at ink feed passage 283 will increase by about 2000 dynes/cm$^2$, and the pressure at ink feed passage 285 will decrease by about 6000 dynes/cm$^2$.

Embodiments of the present invention pertain to inkjet printing systems in which a printhead includes at least two arrays of drop ejectors for ejecting drops of a particular ink such that the two arrays are supplied by different ink paths having different carriage-scan-axis projections, either different in magnitude or direction of the projection. From the discussion above, it is evident that acceleration-induced pressure changes are smaller for an ink path having a shorter carriage-scan-axis projection. In addition, if a positive pressure change is more deleterious for printing by a particular drop ejector array in a printing system than a negative pressure change, then, for example, printing on acceleration can result in worse print quality for that drop ejector array for a leftward pass than for a rightward pass, while printing on deceleration can result in worse print quality for a rightward pass than for a leftward pass.

In a first embodiment, (with reference to FIGS. 2 and 7) two drop ejector arrays 253 are each supplied with a black ink that is compatible with printing text on plain paper. One of the two drop ejector arrays is fed, for example, by ink feed passage 281, and the other drop ejector array is fed by ink feed passage 283. It is found that printing on acceleration or deceleration up to about 2g (i.e., 2 times the acceleration due to gravity) is satisfactory, but printing on acceleration or deceleration (depending on carriage direction) at 3 g for the drop ejector array fed by ink passage 281 can cause excessive positive pressure, resulting in face flooding. The pressure at which the ink meniscus can break and lead to face flooding is also called the Laplace pressure, which is equal to the surface tension of the ink, divided by the nozzle diameter. For an ink surface tension of 35 dynes/cm and a 20 micron nozzle diameter, the Laplace pressure is approximately 8750 dynes/cm$^2$. As discussed above, the magnitude of the pressure increase is given by $|\Delta P|=\rho La$. For manifold passage 231, having a carriage-scan-axis projection of $L_1$=3 cm, $|\Delta P|$~6000 dynes/cm$^2$ for an acceleration of about 2 g. Therefore, a pressure increase of around 6000 dynes/cm$^2$ does not cause degradation of printing by face flooding, but a pressure increase of $|\Delta P|$~9000 dynes/cm$^2$, corresponding to an acceleration of 3 g, does cause printing degradation. However, since manifold passage 233 has a carriage-scan-axis projection of $L_3$=1 cm, even at 3 g the pressure increase is only $|\Delta P|$~3000 dynes/cm$^2$, so there would not be printing degradation for the drop ejector array fed by ink feed passage 283 at 3 g. In order to provide good image quality at high speed by printing during high values of acceleration or deceleration, the drop ejector array that is fed by the manifold passage (e.g. 283) having a shorter carriage-scan-axis projection is used to print dots preferentially during acceleration or deceleration, while printing is more evenly allocated between the two drop ejector arrays (or preferentially allocated to the drop ejector array that is fed by the manifold passage having a longer carriage-scan axis projection) when the carriage is moving at a substantially constant velocity.

Figure 8:
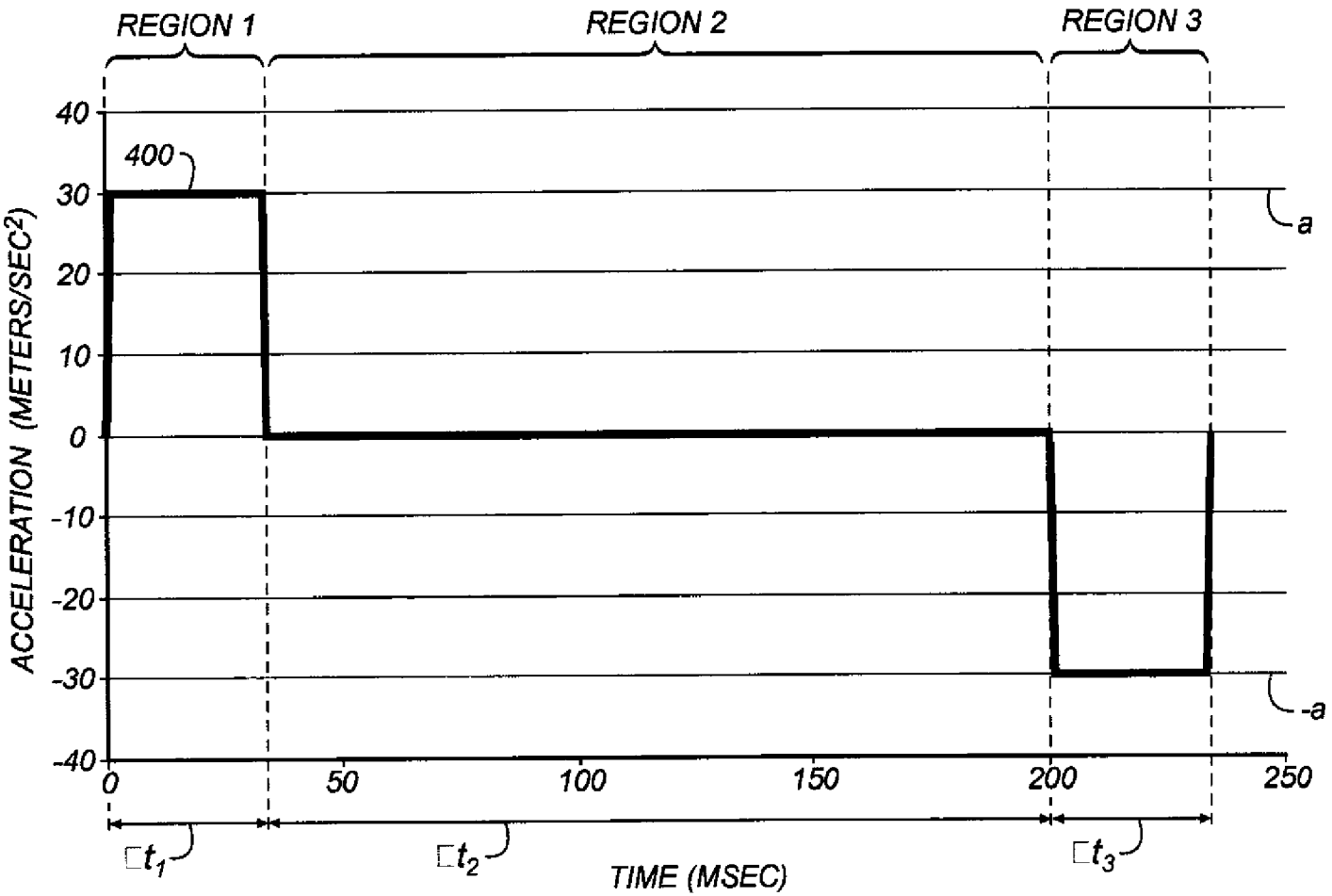
FIG. 8 shows an exemplary carriage acceleration profile.
Figure 9:
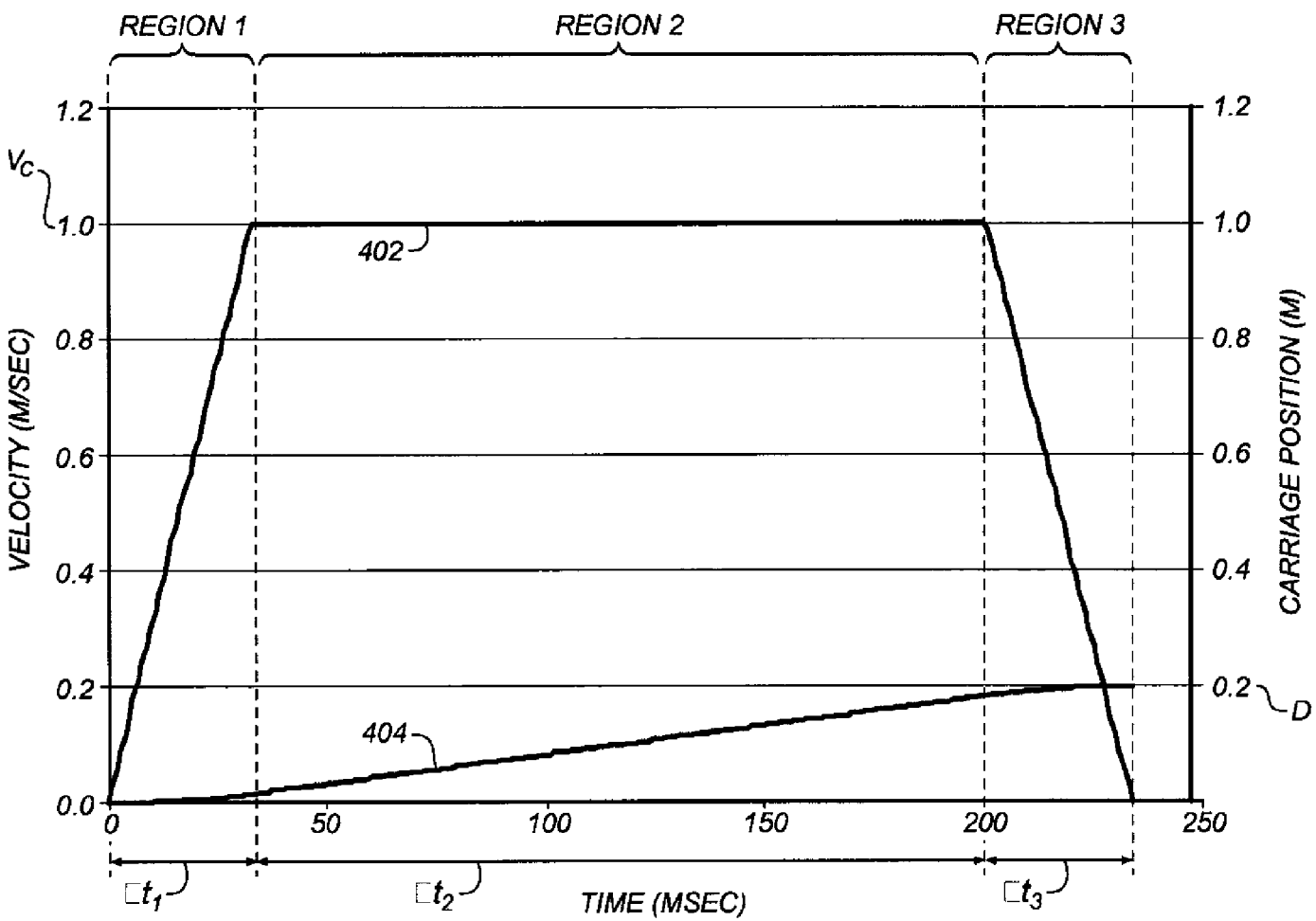
FIG. 9 shows carriage velocity and printhead position as a function of time during a printing pass with the carriage acceleration profile of FIG. 8.
Figure 10:
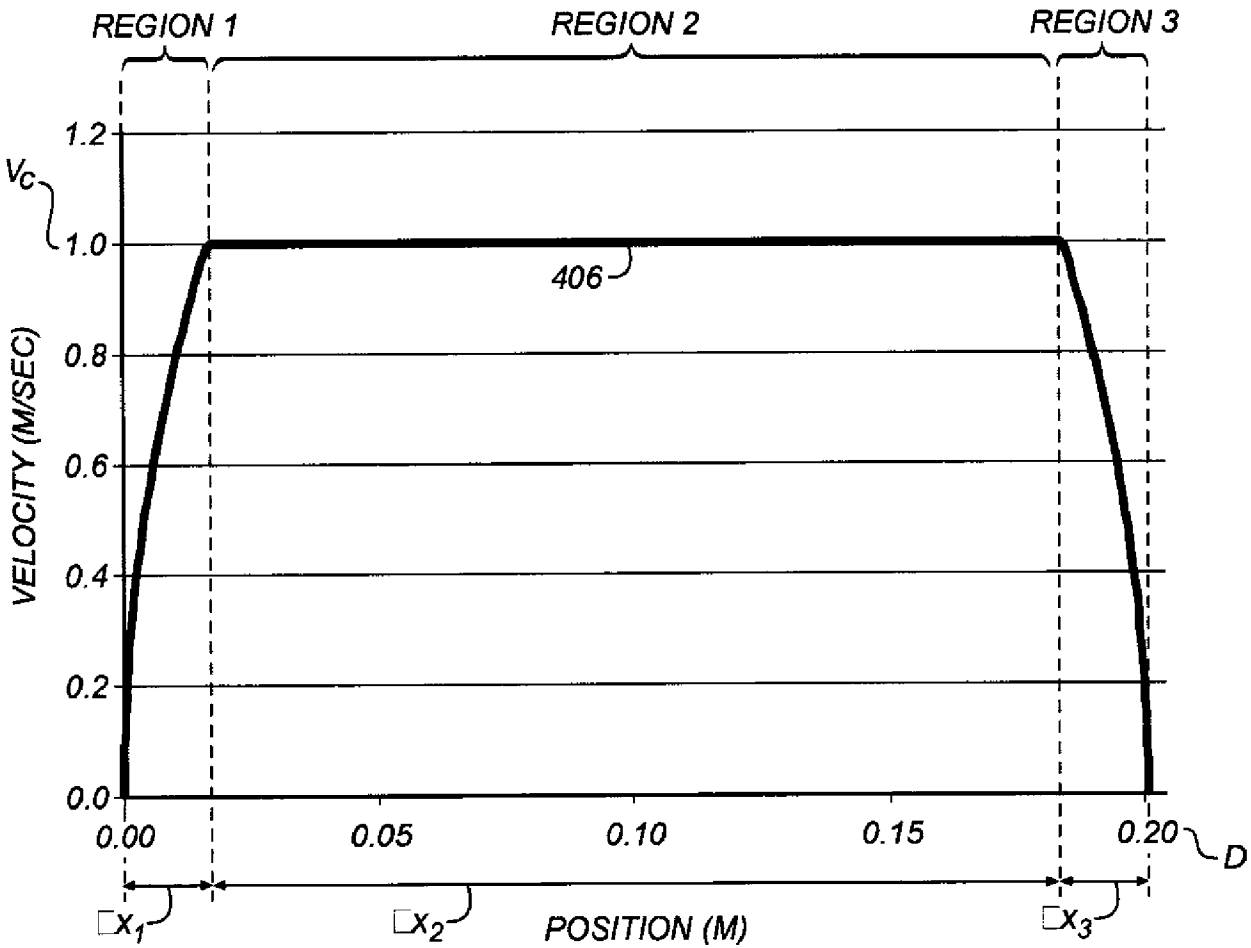
FIG. 10 shows carriage velocity as a function of printhead position during a printing pass with the carriage acceleration profile of FIG. 8.

FIGS. 8-10 show a typical example of carriage motion in terms of acceleration, velocity, printhead position and time for a case of a carriage scan distance D of 20 cm, i.e. about 8 inches. FIG. 8 shows an acceleration vs. time profile 400 of acceleration versus time, in which the carriage acceleration is a=30 m/sec$^2$ (−3 g) in region 1, 0 m/sec$^2$ in region 2, and −30 m/sec$^2$ in region 3. In this example, in region 2 the carriage travels at a substantially constant velocity $v_c$ of 1 msec. The time required for the carriage to accelerate from 0 to 1 msec with a constant acceleration of 3 m/sec$^2$ is $\Delta t_1$=v/a=33 msec (0.033 second). Similarly, in region 3, to decelerate from 1 msec to 0 m/s will also take $\Delta t_3$=33 msec. In terms of the constant velocity $v_c$, the length of region 1 and region 3 will each be $\Delta x_1=\Delta x_3=v_c^2/2a$=0.0167 m, i.e. 1.67 cm. The length of region 2 having constant velocity $v_c$ will be $\Delta x_2=(D-\Delta x_1-\Delta x_3)$=16.67 cm. The time required for region 2 is $\Delta t_2=\Delta x_2/v_c$=0.167 sec. The total length of time for the carriage scan is $\Delta t_1+\Delta t_2+\Delta t_3$=0.233 sec.

FIG. 9 shows the velocity profile vs. time 402 as a function of time and position vs. time 404 of the carriage as a function of time for the acceleration profile of FIG. 8. In region 1, velocity increases linearly and position increases quadratically with time. In region 2, velocity is constant and position increases linearly with time. In region 3, velocity decreases linearly with time and the position increases more slowly than linearly.

FIG. 10 shows the carriage velocity vs. position profile 406 during the carriage scan described by FIGS. 8 and 9. In region 1 velocity increases as the square root of (2ax), where x is the distance from the initial point, and in region 3 the velocity decreases in a similar fashion. In region 2, the velocity is constant as a function of position. Typically the motor controller for carriage motor 380 (with reference to FIG. 3) controls carriage velocity as a function of position, where the position of the carnage 200 is provided by the encoder sensor's reading of the encoder fence 383.

In other embodiments, more complex acceleration profiles than that shown in FIG. 8 can be used. In the simple acceleration profile of FIG. 8, there is a very high rate of change of acceleration versus time (also called jerk in physics). Rather than the nearly instantaneous changes between acceleration values shown in FIG. 8, more gradual changes in acceleration can be used in other embodiments. In any case, during a scan of a reciprocating carriage there will be a first region where the carriage is accelerating from a stopped position, a second region where the carriage moves at substantially constant velocity, and a third region where the carriage is decelerating to a stopped position.

The problems caused by the pressure changes that occur during the acceleration and deceleration intervals are increasingly significant as the magnitude of the acceleration is increased. Since the magnitude of the required acceleration is tied to the maximum carriage velocity, the problems are also increasingly significant as the maximum velocity is increased. This invention is therefore particularly relevant for inkjet printing systems that use high velocity and acceleration values. In particular, it has been found to provide substantial advantages for cases where the acceleration is greater than about 15 m/s$^2$ for some common print head configurations. Depending on various system parameters, these accelerations are encountered when the maximum constant velocity is on the order of 1 m/s or greater. The problems caused by the pressure changes are also increasingly significant for print heads having long manifold passages. It has been found that the present invention provides substantial advantages when the length projections of the manifold passages are greater than about 2 cm. (Note that the particular acceleration, maximum velocity and length projection values where problems start to occur are highly dependent on many print head, ejector and ink parameters. Therefore, in some cases the present invention can provide a substantial advantage for values even lower than those listed here.)

Figure 11:
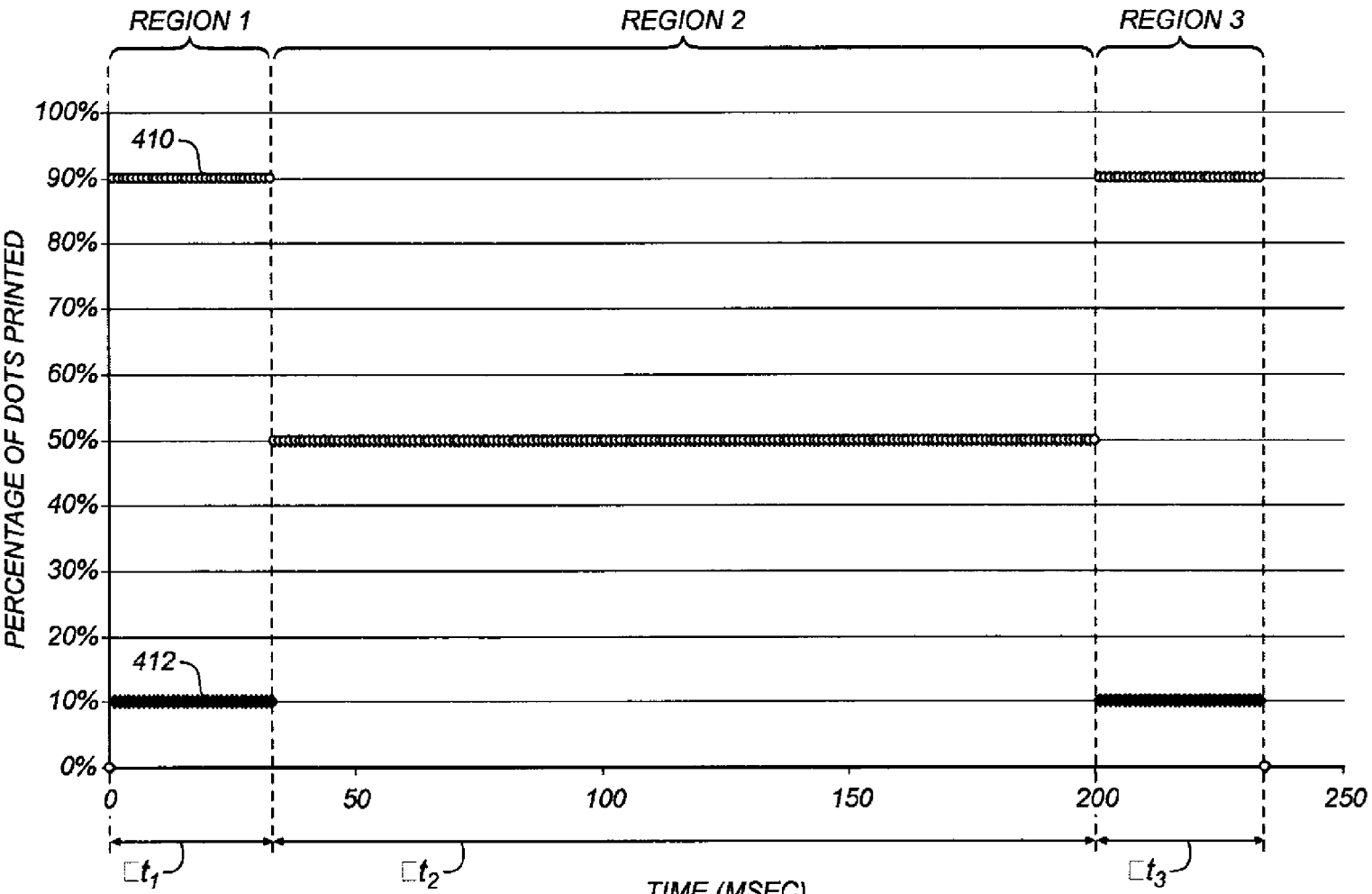
FIG. 11 shows an example of the percentage of dots of a particular ink that are printed by two drop ejector arrays during a printing for the carriage acceleration profile of FIG. 8.

FIG. 11 illustrates how dots of a black ink are printed using two drop ejector arrays for the carriage acceleration profile described with reference to FIGS. 8-10 in an embodiment of the invention. The combined number of black drops that are to be printed as a function of position along the scan will be determined by the image content and any color transforms that are applied to the image data. The combined number of black drops is divided between the two drop ejector arrays of drop ejectors. In this example, a first drop ejector array prints a percentage $P_F(t)$ of the combined number of black dots, and a second drop ejector array prints a percentage $P_S(t)=(100\%-P_F(t))$ of the black dots.

For this example, the first drop ejector array will be assumed to be the drop ejector array that is fed by ink feed passage 283 having the shorter carriage-scan-axis projection $L_3$, and the second drop ejector array will be assumed to be the drop ejector array that is fed by ink feed passage 281 having the longer carriage-scan-axis projection $L_1$. First dot percentage curve 410 (open circles) represents the percentage $P_F(t)$ of the combined number of black dots that are printed in the three regions by the first drop ejector array, and second dot percentage curve 412 (filled diamonds) represents the percentage $P_S(t)$ of the combined number of black dots that are printed in the three regions by the second drop ejector array.

In this example, in both the acceleration region 1 and the deceleration region 3, the percentage of dots printed by the first drop ejector array having the shorter carriage-scan-axis projection $L_3$ is chosen to be $P_F(t)=90\%$. Thus, $P_S(t)=10\%$ of the dots are printed by the second drop ejector array fed by the ink passage having the longer carriage-scan-axis projection $L_1$. The percentages of dots printed with the two drop ejector arrays reflects the fact that the second drop ejector array is more susceptible to jet misfiring due to ink pressure changes. In this example, it is assumed that the jets in the drop ejector array susceptible to misfiring do not always misfire, but only if fired at full frequency, so firing a small percentage of dots from this array is still acceptable, especially because the other array that is less susceptible to misfiring prints a large percentage of the dots in the acceleration and deceleration regions and can disguise any residual print defects. Depending on how large the impact of acceleration or deceleration induced pressure changes is on the drop ejector arrays, a percentage of dots $P_S(t)$ printed by the second drop ejector array having the longer carriage-scan-axis projection is typically chosen to be from 0% to 40% of the combined dots printed in an acceleration region or in a deceleration region (or both). In the example of FIG. 11, in region 2 where carriage velocity is substantially constant, both drop ejector arrays are chosen to fire 50% of the dots. In FIG. 11, the open circles of the first dot percentage curve 410 are on top of the black diamonds of the second dot percentage curve 412, but both are at $P_F(t)=P_S(t)=50\%$.

In the example of FIG. 11, the first drop ejector array corresponding to the first dot percentage curve 410 will use ink at a greater rate in this print mode than the second drop ejector array corresponding to the second dot percentage curve 412, because the percentages the first dot percentage for curve 410 are greater than for the second dot percentage curve 412 in both regions 1 and 3, and the percentages are equal in region 2. It can be advantageous to select percentages such that the total amount of ink used by first and second drop ejector arrays is more nearly equalized, especially if both drop ejector arrays are fed by different black ink chambers of a multi-chamber ink tank, so that one chamber does not tend to run out of ink faster than the other chamber.

Depending on the content of the images printed during the life of an ink chamber, the average combined dot count per area can be somewhat different in the regions 1, 2 and 3. (For example, regions 1 and 3 are more likely to contain white "margin areas" on a page than region 2.) However, for many applications it can be assumed that the average combined dot count per area for regions 1, 2 and 3 is substantially equal. Based on this assumption, the dot percentages in region 2 can be adjusted accordingly so that the amount of ink used by the two drop ejector arrays is more nearly equal.

From the above discussion relative to the acceleration profile of FIG. 8, the distance traveled in each of region 1 and region 3 is $\Delta x_1=\Delta x_3=v_c^2/2a$, so the total fraction of the carriage scan that occurs with a non-constant velocity is $v_c^2/Da=1/6$ for $v_c=1$ msec, D=0.2 m, and a=30 m/sec$^2$. That means, in this example, 5/6 of the carriage scan is at substantially constant velocity. Thus if the percentage of the dots $P_F(t)$ that is printed by the first drop ejector array fed by the ink feed passage having the shorter carriage-scan-axis projection is $P_a$ in the acceleration region 1, $P_c$ in the constant velocity region 2, and $P_d$ in the deceleration region 3, and if $P_a=P_d$, then setting the amount of ink used by the two drop ejector arrays during the entire carriage scan implies that:

$$(v_c^2/Da)P_a+(1-v_c^2/Da)P_c=(v_c^2/Da)(1-P_a)+(1-v_c^2/Da)(1-P_c) \quad (3)$$

Plugging in the values of the example, $P_a/6+5P_c/6=(1-P_a)/6+5(1-P_c)/6$. This reduces to $P_a+5P_c=3$. If, as in the example, the percentage printed in regions 1 and 3 by the first drop ejector array fed by the ink feed passage having the shorter carriage-scan-axis projection, is $P_a=90\%$, then that same drop ejector array will print $P_c=42\%$ in region 2 in order to equalize the ink usage between the two arrays. The second drop ejector array fed by the ink feed passage having the longer carriage-scan-axis projection will thus print 58% of the combined number of black dots in the constant velocity region 2.

In some cases where very high maximum velocities are used, the width of region 2 can become very small, or even nonexistent. For example, the carriage 200 can accelerate for the first half of the swath reaching a maximum velocity in the center of the swath, and then immediately start to decelerate without ever maintaining a constant velocity. As a result, there are only two regions involved, an acceleration region and a deceleration region. In this case, the drop ejector array fed by the ink feed passage having the longer carriage-scan axis projection would be allocated a lower percentage of the ink drops at least one of the acceleration or deceleration regions than the drop ejector array fed by the ink feed passage having the shorter carriage-scan axis projection.

Figure 12:
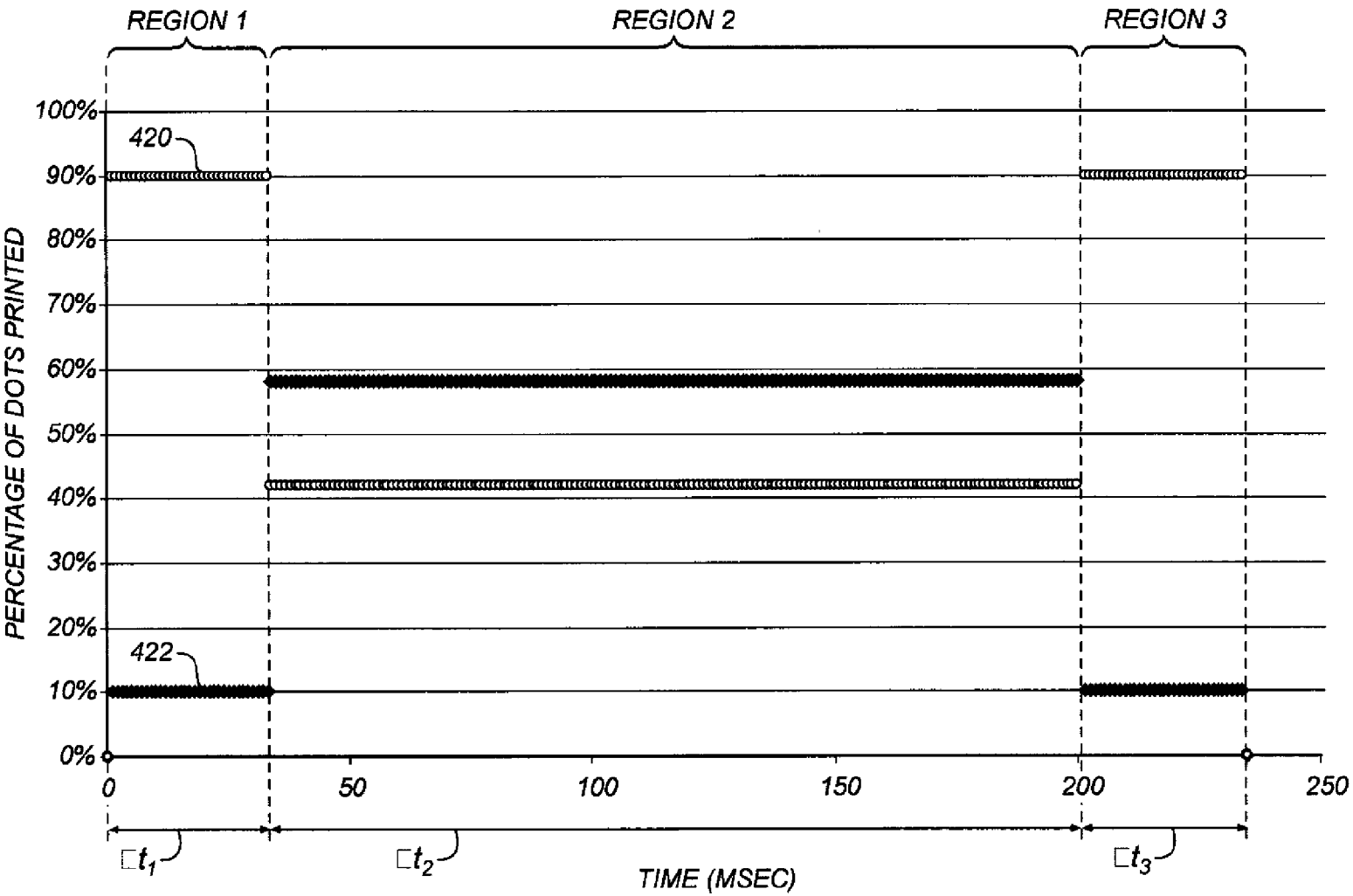
FIG. 12 shows another example of the percentage of dots of a particular ink that are printed by two drop ejector arrays during a printing for the carriage acceleration profile of FIG. 8.

FIG. 12 illustrates the case where the percentage of dots printed using first and second drop ejector arrays are adjusted according to these percentages. In this example, the second drop ejector array fed by the ink passage having the longer carriage-scan-axis prints only 10% of the black dots in region 1 and region 3, but 58% of the dots in region 2 (see second dot percentage curve 422), while the first drop ejector array prints 90% of the dots in region 1 and region 3, but only 42% of the dots in region 2 (see first dot percentage curve 420).

In another example, the second drop ejector array fed by the ink feed passage having the longer carriage-scan-axis projection prints none of the dots in regions 1 and 3 (i.e. $P_a=P_d=100\%$). Then in region 2, the first drop ejector array fed by the ink feed passage having the shorter carriage-scan-axis projection prints $P_c=40\%$ of the combined dots, and the second drop ejector array fed by the ink feed passage having the longer carriage-scan-axis projection prints the other 60% of the dots.

As indicated by Eq. 2 equalizing the ink usage by adjusting the allocation in the constant velocity region depends on the values of the constant velocity $v_c$, the carriage scan distance D, the acceleration a, and the allocation percentage in the acceleration and deceleration regions $P_a$. Consider an example similar to the one discussed above where the only change is that $v_c$ is 1.5 m/sec, rather than 1 m/sec. Plugging in these values into Eq. 3 yields $3P_a+5P_c=4$. If in the acceleration and deceleration regions, $P_a=P_d=100\%$ (i.e. none of the dots are printed in regions 1 and 3 by the second drop ejector array fed by the ink feed passage having the longer carriage-scan-axis projection), then $P_c=20\%$. In other words, to equalize ink usage in this example, 80% of the dots in region 2 would be printed by the second drop ejector array fed by the ink feed passage having the longer carriage-scan-axis projection.

Figure 13A:
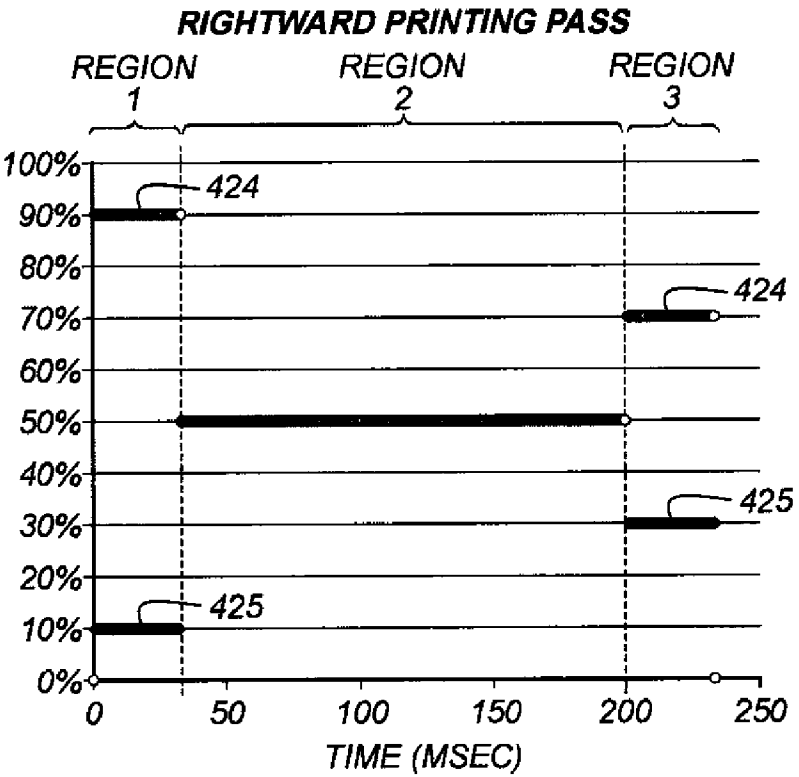
FIGS. 13A and 13B show a third example of the percentage of dots of a particular ink that are printed by two drop ejector arrays during a rightward and a leftward printing pass respectively for the carriage acceleration profile of FIG. 8.

In other embodiments, the percentage of the combined number of dots allocated between the two drop ejector arrays is chosen to be different in the acceleration region 1 and the deceleration region 3. In addition, the printing allocation in region 1 or region 3 can be different for rightward and leftward printing passes. This can be the case if a positive change in pressure is either a greater or lesser cause of printing problems than a negative change in pressure. For example, consider the case illustrated in FIGS. 13A and 13B. For a rightward printing pass, the drop ejector array fed by the ink feed passage having the longer carriage-scan-axis projection prints 10% of the combined number of dots in acceleration region 1 (the leftmost portion of the image in a rightward printing pass) and 30% of the combined number of dots in deceleration region 3 (the rightmost portion of the image in a rightward printing pass) as shown by first dot percentage curve 424 in FIG. 13A. The drop ejector array fed by the ink feed passage having the shorter carriage-scan-axis projection correspondingly prints 90% of the combined number of dots in acceleration region 1 and 70% of the combined number of dots in deceleration region 3, as shown by second dot percentage curve 425 in FIG. 13A.

Figure 13B:
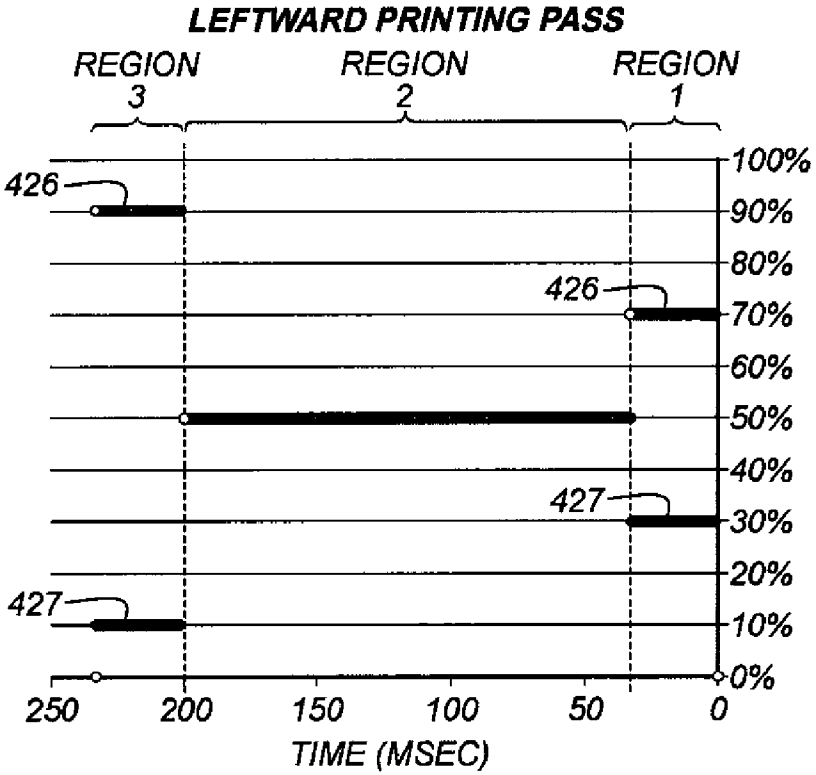

Then, because the pressure difference changes sign when the carriage is moving in the opposite direction, it would be appropriate in the subsequent leftward printing pass to allocate 30% of the combined dots in acceleration region 1 (the rightmost portion of the image in a leftward printing pass) and 10% of the combined dots in deceleration region 3 (the leftmost portion of the image in a leftward printing pass) for the drop ejector array fed by the ink feed passage having the longer carriage-scan-axis projection, as shown by first dot percentage curve 426 in FIG. 13B. (Note that the time axis in FIG. 13B has been reversed relative to FIG. 13A, so that the right side of the figures corresponds to the right side of the image in both cases.) Second dot percentage curve 427 in FIG. 13B shows the corresponding dot percentages for the for the drop ejector array fed by the ink feed passage having the shorter carriage-scan-axis projection Note that in this example the drop ejector array fed by the ink feed passage having the longer carriage-scan-axis projection prints 10% of the combined number dots on the left-hand side of the image and 30% of the combined number of dots on the right-hand side of the image for both leftward and rightward printing passes (first dot percentage curve 424 in FIG. 13A and first dot percentage curve 426 in FIG. 13B). This can be advantageous in avoiding swath-to-swath banding due to changes in printing allocation at a particular side of the image.

In other embodiments, the two drop ejector arrays for printing a particular ink are fed by ink feed passages having similar carriage-scan-axis projection lengths, but pointing in opposite directions from manifold entry port to manifold exit port, such as ink passages 231 and 235 in FIG. 7. In such embodiments, even though the projection lengths $L_1$ and $L_5$ are similar, it can still be advantageous to have different percentages of dots printed by the two different drop ejector arrays in acceleration region 1 and deceleration region 3 if a positive pressure change creates more or fewer printing problems than a negative pressure change. Furthermore, as in the previous example, these different percentages can shift back and forth between the acceleration region and the deceleration region in leftward and rightward printing passes, but at a given side of the image, the percentage of dots printed by a given drop ejector array can often be the same for all printing passes.

Changing the allocation of the printing in the acceleration and deceleration regions depending on whether the printhead is moving in a rightward printing pass or a leftward printing pass can be described in a more general fashion. As seen in the examples above, the printhead includes two drop ejector arrays for ejecting drops of a particular ink, such that a first drop ejector array is supplied by a first ink path characterized by a first carriage-scan-axis projection and a second drop ejector array is supplied by a second ink path characterized by a second carriage-scan-axis projection. The first and second carriage-scan-axis projections can be different either in length or in direction. Together, the first and second drop ejector arrays print a first combined number of ink dots during a time interval while the printhead is accelerating, and $P_{Fa}$ is the percentage of ink dots that are printed by the first drop ejector array. Similarly, during a time interval in the substantially constant velocity region, $P_{Fc}$ is the percentage of the second combined number ink dots that are printed by the first drop ejector array. Also during a time interval in the deceleration region $P_{Fd}$ is the percentage of the third combined number of ink dots that are printed by the first drop ejector array. During a rightward printing pass, the ratio $P_{Fd}/P_{Fd}$ has a value $R_R$, and during a leftward printing pass the ratio $P_{Fa}/P_{Fd}$ has a value $R_L$. In an example described above, $R_R=P_{Fa}/P_{Fd}=10\%/30\%=0.33$ in a rightward printing pass, and $R_L=P_{Fa}/P_{Fd}=30\%/10\%=3.0$ in a leftward printing pass. In this example $R_L$ is about 90% different from $R_R$. In another example, $R_R=P_{Fa}/P_{Fd}=28\%/32\%=0.875$ in a rightward printing pass and $R_L=P_{Fa}/P_{Fd}=32\%/28\%=1.143$ in a leftward printing pass. In this $R_L$ is about 23% different from $R_R$. In general, when there is a need for different printing allocations for leftward and rightward printing passes, the difference between $R_L$, and $R_R$ will typically be greater than 10%.

It can also be advantageous to change the allocation of printing between two drop ejector arrays more gradually than in the examples of FIGS. 11 and 12. For example, rather than abruptly changing between the printing allocations in regions 1, 2 and 3, it can be beneficial to include a first transition region between regions 1 and 2 and a second transition region between regions 2 and 3 where intermediate percentages are allocated for the first and second drop ejector arrays. This can reduce the likelihood of forming visible artifacts at the transition points.

Figure 14:
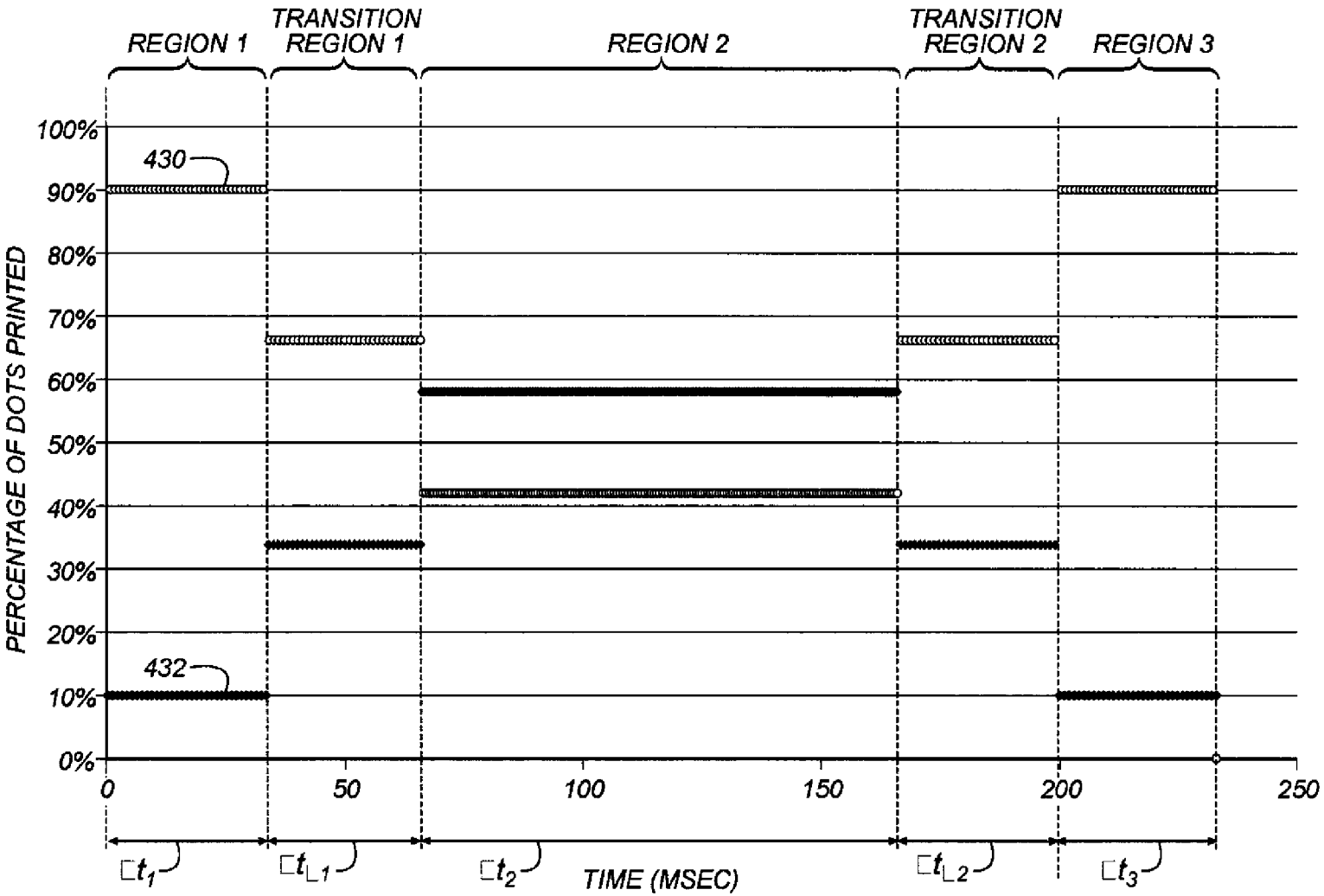
FIG. 14 shows a fourth example of the percentage of dots of a particular ink that are printed by two drop ejector arrays during a printing for the carriage acceleration profile of FIG. 8.

FIG. 14 shows an example similar to FIG. 12, where constant intermediate percentages are allocated. First dot percentage curve 430 (open circles) represents the percentages of dots that are printed by the first drop ejector array that is fed by ink feed passage 283 having the shorter carriage-scan-axis projection $L_3$. Second dot percentage curve 432 (filled diamonds) represents the percentage of the dots that are printed by the second drop ejector array that is fed by ink feed passage 281 having the longer carriage-scan-axis projection $L_1$. Five time intervals are shown in this case. Time interval $\Delta t_1$ corresponds to region 1, where 90% of the dots are allocated to the drop ejector array fed by the ink passage having the shorter carriage-scan-axis projection and 10% of the dots are allocated to the drop ejector array fed by the ink passage having the longer carriage-scan-axis projection. Time interval $\Delta t_3$ corresponds to region 3, having a similar allocation as time interval $\Delta t_1$. Constant velocity region 2 includes three time intervals $\Delta t_{T1}$, $\Delta t_2$ and $\Delta t_{T2}$. During time interval $\Delta t_2$, the printing allocation is similar to that used in region 2 in FIG. 12 (i.e. 58% for the second drop ejector array fed by the ink passage having the longer carriage-scan-axis projection). A first transition time interval $\Delta t_{T1}$ is at the beginning of constant velocity region 2 (between time intervals $\Delta t_1$ and $\Delta t_2$) and a second transition time interval $\Delta t_{T2}$ is at the end of constant velocity region 2 (between time intervals $\Delta t_2$ and $\Delta t_3$). In this example, the allocations in the transition time intervals $\Delta t_{T1}$ and $\Delta t_{T2}$ are chosen to be halfway between the allocations in time interval $\Delta t_1$ and $\Delta t_2$, and $\Delta t_2$ and $\Delta t_3$, respectively, for each of the two drop ejector arrays. In other examples, the allocation of printing in intermediate time intervals can be at percentages that are different than halfway between the allocations for the neighboring time intervals.

Figure 15:
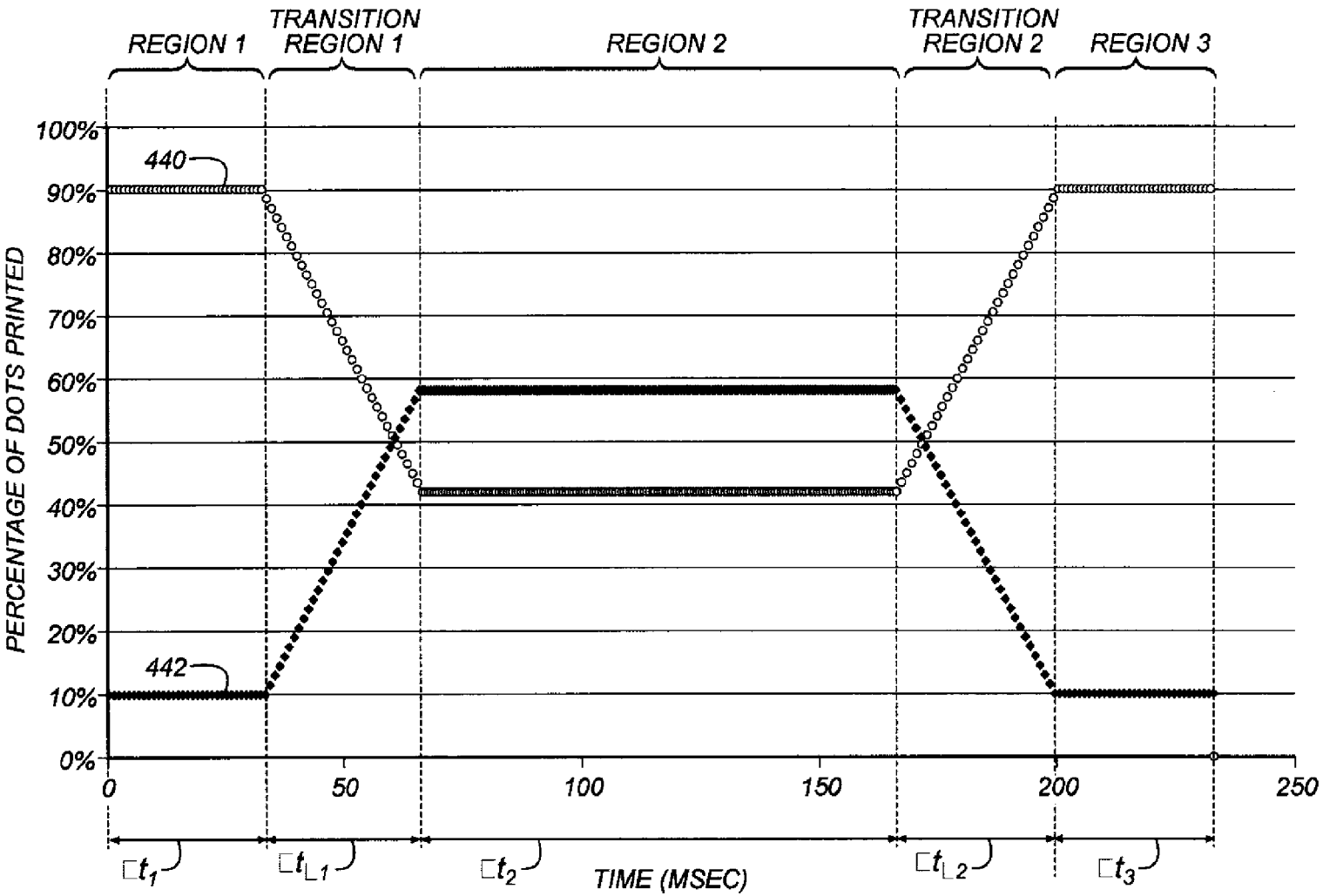
FIG. 15 shows a fifth example of the percentage of dots of a particular ink that are printed by two drop ejector arrays during a printing for the carriage acceleration profile of FIG. 8.

Alternatively, instead of the dot percentages being held constant in the transition time intervals, they can be changed in a plurality of discrete steps or can be changed continuously between the dot percentages in regions 1, 2 and 3. FIG. 15 shows an example similar to FIG. 12, where the dot percentages are changed continuously in the transition time intervals. First dot percentage curve 440 (open circles) represents the percentages of dots that are printed by the first drop ejector array that is fed by ink feed passage 283 having the shorter carriage-scan-axis projection $L_3$. Second dot percentage curve 442 (filled diamonds) represents the percentage of the dots that are printed by the second drop ejector array that is fed by ink feed passage 281 having the longer carriage-scan-axis projection $L_1$. During the first transition time interval $\Delta t_{T1}$ the dot percentages are changed continuously using a linear transition function between the dot percentages in region 1 and the dot percentages in region 2. Likewise, during the second transition time interval $\Delta t_{T2}$ the dot percentages are changed continuously using a linear transition function between the dot percentages in region 2 and the dot percentages in region 3. A continuous transition of the percentage of dots that are printed by the first and second drop ejector arrays can be advantageous in avoiding artifacts at the transition points and in providing a more uniform image appearance across the swath.

Figure 16:
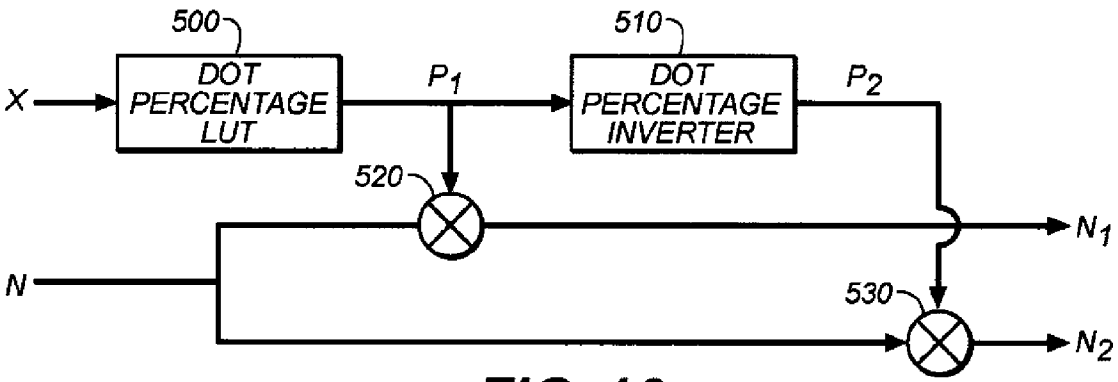
FIG. 16 shows a flowchart for one embodiment of the present invention using a dot percentage LUT.

The examples shown in FIGS. 11-15 define curves that specify the desired dot percentages as a function of time/printhead position. There are a variety of ways that the dot percentages to be printed by the first and second drop ejector arrays can be controlled according to the method of the present invention. One embodiment is shown in FIG. 16. A dot percentage look-up table (LUT) 500 is used to store the first dot percentage $P_1$ for the first drop ejector array as a function of the printhead position X. The printhead position X used to address the dot percentage LUT 500 is generally quantized to a certain position interval ΔX. The number of the entries in the dot percentage LUT 500 will depend on the width of the carriage scan distance D and the position interval ΔX. For example, if D=20 cm and ΔX=0.1 cm, the dot percentage LUT 500 would need to store D/ΔX=200 entries corresponding to 200 positions distributed uniformly across the scan length. Alternatively, in some implementations, the dot percentage LUT 500 can be addressed as a function of time rather than position. The first dot percentage $P_1$ can be stored as a percentage in the range of 0% to 100%, or alternatively as a fraction in the range of 0.0 to 1.0. In a preferred embodiment of the present invention, the dot percentage is stored using a defined integer encoding. For example, the dot percentage can be stored as an 8-bit integer where code value 0 corresponds to a dot percentage of 0 and code value 255 corresponds to a dot percentage of 255.

A dot percentage inverter 510 is used to determine the corresponding dot percentage for the second drop ejector array $P_2$. If the first dot percentage $P_1$ is stored as an actual percentage, then the second dot percentage $P_2$ for the second drop ejector array can be calculated by the formula $P_2=100-P_1$. Similarly, if the first dot percentage $P_1$ is stored as a fraction, then $P_2=1.0-P_1$, or if the first dot percentage $P_1$ is stored as an 8-bit integer, then $P_2=255-P_1$. The dot percentage inverter 510 can perform these calculations directly using integer or floating point math. Alternatively, the dot percentage inverter 510 can be a look-up table that stores the value of second dot percentage $P_2$ as a function of first dot percentage $P_1$.

A first number of ink dots $N_1$ that should be printed using the first drop ejector array can be determined by multiplying the combined number of dots N by the first dot percentage $P_1$ using multiplier 520. Likewise, a second number of dots of ink $N_2$ that should be printed using the second drop ejector array can be determined by multiplying the combined number of dots N by the second dot percentage $P_2$ using multiplier 530. The process shown in FIG. 16 is generally applied after any color management transforms have been applied in the ink jet printer imaging chain, but before any multitoning steps have been applied. Therefore, the combined number of dots N will generally encoded as an integer value of a specified bit-depth. In a preferred embodiment of the present invention, N will be an 8-bit integer where 0 corresponds to printing no ink dots and 255 corresponds to printing the maximum number of ink dots at a particular location. The values of the first number of ink dots $N_1$ and the second number of ink dots $N_2$ will generally use the same encoding range as is used for N, but this is not required.

Figure 17:
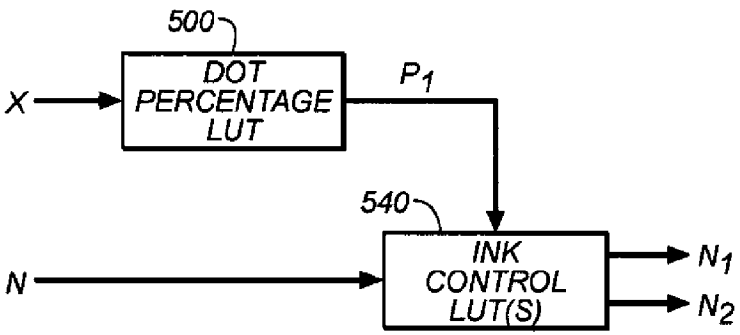
FIG. 17 shows a flowchart for another embodiment of the present invention using an ink control LUT.

In a preferred embodiment of the present invention, a look-up table can be used to calculate the first number of ink dots $N_1$ and the second number of ink dots $N_2$ rather than using multipliers 520 and 530. This is illustrated in FIG. 17. As with the method shown in FIG. 16, a dot percentage LUT 500 is used to determine the first dot percentage $P_1$ as a function of the printhead position X. Ink control LUT(s) 540 are then addressed using the combined number of dots N and the first dot percentage $P_1$ to determine the first number of ink dots $N_1$ and the second number of ink dots $N_2$. In one implementation the ink control LUT(s) 540 is a 2-dimensional look-up table (2-D LUT) that is addressed in one dimension by the combined number of dots N and in the other dimension by the first dot percentage $P_1$. There can either be a single 2-D LUT that stores the values of both $N_1$ and $N_2$ at each node, or alternatively, there can be one 2-D LUT that stores $N_1$ and a second 2-D LUT that stores $N_2$.

In one implementation, the ink control LUT(s) 540 store the values of $N_1$ and $N_2$ for every possible combination of N and $P_1$. However, this can require an excessive amount of memory for storage of the ink control LUT(s) 540. Therefore, in some cases, it can be advantageous to use sparse ink control LUT(s) 540 that store only a subset of the input values. For example, the ink control LUT(s) 540 can only store the values of $N_1$ and $N_2$ for only 16 different values of N and $P_1$ rather than 256 values. In this case, it will generally be desirable to use an interpolation technique to interpolate between the sparse entries stored in the ink control LUT(s) 540. This approach can substantially reduce the amount of memory required at the cost of some additional computation time.

In yet another implementation of the present invention, the ink control LUT(s) 540 are a set of one-dimensional look-up tables (1-D LUTs). For example, a set of 1-D LUTs can be provided where each member in the set corresponds to a different value of $P_1$. In this case, the value of $P_1$ is used to select an appropriate 1-D LUT, and then the selected 1-D LUT is addressed by the combined number of dots N in order to determine the values of $N_r$ and $N_2$. In one embodiment of the present invention, the value of $P_1$ is quantized to a limited number of different values (e.g., 16) and a 1-D LUT is provided for each of the quantized values. The number of different quantized values of $P_1$ will control how abruptly the dot percentages will change across the scan line. Alternatively, the appropriate 1-D LUT can be selected based on the lateral print head position rather than the value of $P_1$.

In another embodiment, the ink control LUT(s) 540 are addressed directly with the printhead position X rather than first dot percentage $P_1$ (which is a function of the printhead position X). In this case, the values stored in the ink control LUT(s) 540 should be modified accordingly to store the result of the cascaded calculations. In yet another embodiment, the ink control LUT(s) 540 are addressed by a parameter that is a function of the printhead acceleration. This has the advantage that the same ink control LUT(s) 540 can be used for different print modes that use different acceleration profiles.

In another embodiment of the present invention, the control of the dot percentages is accomplished as part of the print masking step. Print masking processes are known in the art and are used in multi-pass printing configurations to determine the dot patterns that should be printed on each printing pass as a function of multi-toned image data. Examples of prior art print masking processes can be found in U.S. Patent Application Publication 2008/0309952 and in co-pending U.S. patent application Ser. No. 12/407,130 filed Mar. 19, 2009, entitled "Image Data Expansion by Print Mask" by Christopher Rueby and Douglas Couwenhoven, the disclosure of which is incorporated herein by reference.

Figure 18:
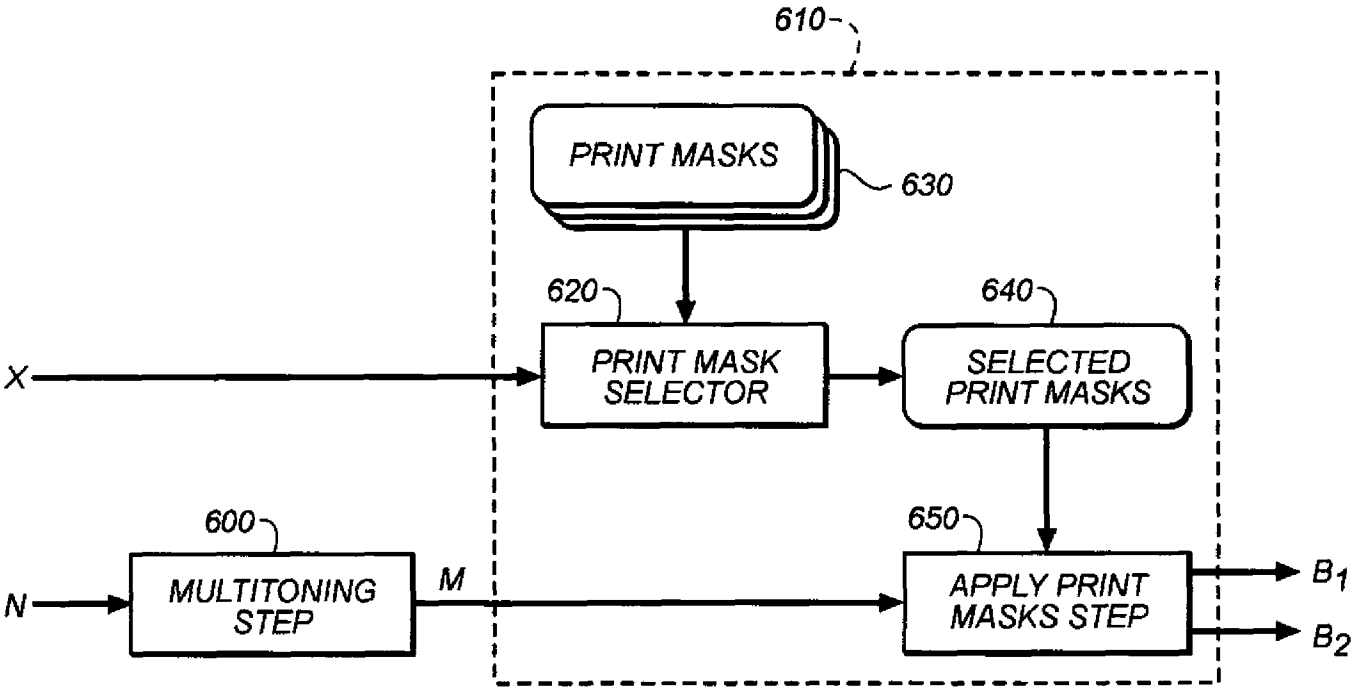
FIG. 18 shows a flowchart for a third embodiment of the present invention using a print mask selector.

FIG. 18 shows an embodiment of the present invention that uses a print masking operation to control the dot percentages printed by first and second drop ejector arrays. A multitoning step 600 is used to determine a multitone code value M that represents to combined number of ink dots that should be printed at a particular location as a function of an input code value N for a particular color channel. The input code value N is generally represented by an integer value of a specified bit-depth. For the present example, it will be assumed that N is an 8-bit integer, with values ranging from 0 to 255, although other bit-depths can be used as well. A value of N=0 corresponds to printing no ink at a particular location, and a value of N=255 corresponds to printing a maximum amount of ink.

A print masking step 610 is used to determine the positions where ink dots should be printed as a function of the multitone code value M and the lateral print head position X. The output of the print masking step 610 is a first binary dot pattern $B_1$ for controlling when drops are to be printed using the first drop ejector array, and a second binary dot pattern $B_2$ for controlling when drops are to be printed using the second drop ejector array. In a preferred embodiment of the present invention, the print masking step 610 includes a print mask selector 620, which selects a pair of selected print masks 640 from sets of print masks 630 depending on the lateral printhead position X.

The sets of print masks 630 include pairs of print masks having different relative allocations of the drops for the two different drop ejector arrays.

For example, to implement the configuration of FIG. 12, a first pair of print masks is configured to print 90% of the ink drops using the first drop ejector array and 10% of the ink drops using the second drop ejector array. A second pair of print masks is configured to print 42% of the ink drops using the first drop ejector array and 58% of the ink drops using the second drop ejector array. The print mask selector 620 selects the first pair of print masks for lateral printhead positions X corresponding to regions 1 and 3 of FIG. 14, and selects the second pair of print masks for lateral printhead positions X corresponding to region 2. Alternatively, there can be more than two sets of print masks for cases where there are more than 2 different sets of dot percentages, such as those shown in FIGS. 14 and 15.

The selected print masks 640 are then used by an apply print masks step 650 to determine the first binary dot pattern $B_1$ to be printed with the first drop ejector array and the second binary dot pattern $B_2$ to be printed with the second drop ejector array. In one embodiment of the present invention, a print masking method similar to that described in U.S. Patent Application Publication 2008/0309952 is used. With this approach, the selected print masks 640 have a series of mask planes corresponding to the different multitone levels produced by the multitoning step 600. The apply print masks step 650 then works by selecting one of the mask planes from the selected print mask for the first drop ejector array using the multitone level M. The selected mask plane is then modularly addressed by the x-y pixel position to determine the first binary dot pattern $B_1$. Likewise, a mask plane is also selected from the selected print mask for the second drop ejector array and is used to determine the second binary dot pattern $B_2$. It will be obvious to one skilled in the art that the method of the present invention can be used with other variations of print masking arrangements besides the example that was described here for illustration.

Although the examples were described with respect to two drop ejector arrays printing black ink, the invention also applies to a plurality drop ejector arrays printing any particular ink, including (but not limited to) cyan, magenta, or yellow, as well as black. In some embodiments of the present invention, two or more drop ejector arrays having different manifold projection lengths can be fed by a single ink supply rather than by two different ink supplies as shown in the examples described herein. In addition, although with reference to FIG. 3, ink supplies were shown as a multi-chamber ink supply 262 having five chambers, and a single-chamber ink supply 264, the ink can be provided in a variety of ways. This can include (for the example of six drop ejector arrays 253), six single-chamber tanks or two three-chamber tanks, for example.

The invention has been described in detail with particular reference to certain preferred embodiments thereof, but it will be understood that variations and modifications can be effected within the spirit and scope of the invention.

PARTS LIST

12 Image data source
14 Controller
15 Image processing unit
16 Electrical pulse source
18 First fluid source
19 Second fluid source
20 Recording medium

100 Inkjet printhead
110 Inkjet printhead die
111 Substrate
120 First nozzle array
121 Nozzles
122 First ink delivery pathway
130 Second nozzle array
131 Nozzles
132 Second ink delivery pathway
181 Ink droplets
182 Ink droplets
200 Carriage
210 Manifold
211 Manifold exit port
212 Manifold exit port
213 Manifold exit port
214 Manifold exit port
215 Manifold exit port
216 Manifold exit port
221 Manifold entry port
222 Manifold entry port
223 Manifold entry port
224 Manifold entry port
225 Manifold entry port
226 Manifold entry port
231 Manifold passage
232 Manifold passage
233 Manifold passage
234 Manifold passage
235 Manifold passage
236 Manifold passage
241 Multi-chamber ink supply region
242 Multi-chamber ink supply connection port
246 Single-chamber ink supply region
248 Single-chamber ink supply connection port
249 Partitioning wall
250 Printhead chassis
251 Printhead die
253 Drop ejector arrays
254 Drop ejector array direction
255 Mounting support member
256 Encapsulant
257 Flex circuit
258 Connector board
262 Multi-chamber ink supply
264 Single-chamber ink supply
266 Ink supply body
267 Lid
268 Lid sealing interface
269 Vents
270 Ink chamber
272 Ink supply ports
281 Ink feed passage
282 Ink feed passage
283 Ink feed passage
284 Ink feed passage
285 Ink feed passage
286 Ink feed passage
300 Printer chassis
302 Paper load entry direction
303 Print region
304 Media advance direction
305 Carriage scan axis
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction
320 Pick-up roller
322 Turn roller
323 Idler roller
324 Discharge roller
325 Star wheel(s)
330 Maintenance station
370 Stack of media
371 Top piece of medium
380 Carriage motor
382 Carriage guide rail
383 Encoder fence
384 Belt
390 Printer electronics board
392 Cable connectors
400 Acceleration vs. time profile
402 Velocity vs. time profile
404 Position vs. time profile
406 Velocity vs. position profile
410 First dot percentage curve
412 Second dot percentage curve
420 First dot percentage curve
422 Second dot percentage curve
424 First dot percentage curve
425 Second dot percentage curve
426 First dot percentage curve
427 Second dot percentage curve
430 First dot percentage curve
432 Second dot percentage curve
440 First dot percentage curve
442 Second dot percentage curve
500 Dot percentage look-up table (LUT)
510 Dot percentage inverter
520 Multiplier
530 Multiplier
540 Ink control LUT(s)
600 Multitoning step
610 Print masking step
620 Print mask selector
630 Print masks
640 Selected print masks
650 Apply print masks step

The invention claimed is:

1. A method for printing input digital images using an inkjet printing system having a printhead that moves laterally in reciprocating fashion along a scan axis, the printhead including first and second drop ejector arrays for ejecting drops of a particular ink wherein a first ink path supplying the first drop ejector array is characterized by a first length projection along the carriage scan axis; and a second ink path supplying the second drop ejector array is characterized by a second length projection along the carriage scan axis, the first length projection being shorter than the second length projection, the method comprising:

a) printing a first combined number of ink dots of the particular ink on a recording medium using the first and second drop ejector arrays during a first time interval where the printhead is accelerating from a stopped position;

b) printing a second combined number of ink dots of the particular ink on the recording medium using the first and second drop ejector arrays during a second time interval where the printhead is moving at a substantially constant velocity, wherein the percentage of ink dots that are printed by the second drop ejector array is between 40% and 80% of the second combined number of ink dots; and c) printing a third combined number of ink dots of the particular ink on a recording medium using the first and second drop ejector arrays during a third time interval where the printhead is decelerating to a stopped position, and further wherein the percentage of ink dots that are printed by the second drop ejector array is less than 40% of the corresponding combined number of ink dots in at least one of the first or third time intervals.

2. The method of claim 1, wherein the percentage of ink dots that are printed by the second drop ejector array during the first time interval is less than or equal to 10% of the first combined number of ink dots.

3. The method of claim 1, wherein the percentage of ink dots that are printed by the second drop ejector array during the third time interval is less than or equal to 10% of the third combined number of ink dots.

4. The method of claim 1, wherein the color of the particular ink is cyan, magenta, yellow or black.

5. The method of claim 1, wherein the acceleration is greater than 15 meters per second or the substantially constant velocity is greater than or equal to 1 meter per second.

6. The method of claim 1, wherein the first length projection is greater than two centimeters.

7. The method of claim 1, wherein the printhead further includes an ink supply port for attaching a replaceable ink tank; and wherein the first ink path connects the ink supply port to the first drop ejector array and the second ink path connects the ink supply port to the second drop ejector array.

8. The method of claim 1, wherein the percentage of ink dots that are printed by the second drop ejector array during the first time interval is different than during the third time interval.

9. The method of claim 1, wherein the percentage of ink dots that are printed by the second drop ejector array during the first time interval is different for rightward printing passes than for leftward printing passes.

10. The method of claim 1, wherein the percentage of ink dots that are printed by the second drop ejector array during the third time interval is different for rightward printing passes than for leftward printing passes.

11. The method of claim 1, further comprising printing ink dots during a first transition time interval between the first time interval and the second time interval, wherein the percentage of ink dots that are printed by the first drop ejector array is intermediate between the percentages associated with the first and second time intervals, and printing ink dots during a second transition time interval between the second time interval and the third time interval, wherein the percentage of ink dots that are printed by the first drop ejector array is intermediate between the percentages associated with the second and third time intervals.

12. The method of claim 11 wherein the percentage of ink dots that are printed by the first drop ejector array in the first transition time interval transitions continuously between the percentages associated with the second and third time intervals and the percentage of ink dots that are printed by the first drop ejector array in the second transition time interval transitions continuously between the percentages associated with the second and third time intervals.

13. The method of claim 1, wherein the percentage of ink dots that are printed by the first and second drop ejector arrays is controlled by indexing an ink control look-up table with a code value representing the amount of the particular ink to be printed at a given position.

14. The method of claim 13 wherein the ink control look-up table is a two-dimensional look-up table, and wherein the ink control look-up table is further indexed by a parameter that is a function of the lateral printhead position.

15. The method of claim 13 wherein the ink control look-up table is a two-dimensional look-up table, and wherein the ink control look-up table is further indexed by a parameter that is a function of the printhead acceleration.

16. The method of claim 13 wherein the ink control look-up table is selected from a set of ink control look-up tables based on the lateral printhead position.

17. The method of claim 13 wherein the ink control look-up table is a sparse look-up table and an interpolation operation is used to interpolate between entries in the sparse look-up table.

18. The method of claim 1, further comprising a multitoning step that determines multitone code values from input code values representing the amount of the particular ink to be printed at each position, and a print masking step that determines the positions where ink dots should be printed as a function of the multitone code values, wherein the behavior of the print masking step is adjusted as a function of a lateral printhead position in order to control the percentage of ink dots that are printed by the first and second drop ejector arrays.

19. The method of claim 18 wherein the print masking step uses different print masks as a function of the lateral printhead position.

* * * * *